US010415207B2

(12) United States Patent
Ditillo et al.

(10) Patent No.: US 10,415,207 B2
(45) Date of Patent: Sep. 17, 2019

(54) MODULAR ASSEMBLY FOR HANDLING EXCAVATING EQUIPMENT FOR EXCAVATING MACHINES, EXCAVATING MACHINE, METHOD FOR CONVERTING THE EXCAVATING CONFIGURATION OF AN EXCAVATING MACHINE

(71) Applicant: SOILMEC S.p.A., Cesena (FC) (IT)

(72) Inventors: Alessandro Ditillo, Cesena (IT); Ezio Biserna, Longiano (IT)

(73) Assignee: SOILMEC S.P.A., Cesena (FC) (IT)

( * ) Notice: Subject to any disclaimer, the term of this patent is extended or adjusted under 35 U.S.C. 154(b) by 0 days.

(21) Appl. No.: 15/911,750

(22) Filed: Mar. 5, 2018

(65) Prior Publication Data

US 2018/0251948 A1 Sep. 6, 2018

(30) Foreign Application Priority Data

Mar. 6, 2017 (IT) ..... 102017000024727

(51) Int. Cl.
*E02D 7/00* (2006.01)
*E21B 7/02* (2006.01)
(Continued)

(52) U.S. Cl.
CPC ..... *E02D 7/00* (2013.01); *E02D 5/36* (2013.01); *E02D 7/18* (2013.01); *E02D 7/30* (2013.01);
(Continued)

(58) Field of Classification Search
CPC .... E02D 7/02; E02D 7/06; E02D 7/14; E02D 7/22; E21B 7/003; E21B 7/005;
(Continued)

(56) References Cited

U.S. PATENT DOCUMENTS 3,604,214 A * 9/1971 Turzillo ..... E02D 3/106 175/323
3,705,634 A * 12/1972 Casagrande ..... E02D 7/16 173/28

(Continued)

FOREIGN PATENT DOCUMENTS

EP 0150977 A2 * 8/1985 ..... E02D 7/16
EP 2468960 A1 6/2012
EP 2662523 A1 11/2013

OTHER PUBLICATIONS

Libebherr-Werk Nenzing Gmbh: Technical data-Piling and drilling rig, XP055439280, pp. 2, 10-12, 2011.

(Continued)

*Primary Examiner* — Frederick L Lagman
(74) *Attorney, Agent, or Firm* — Lucas & Mercanti, LLP

(57) ABSTRACT

A modular assembly for handling excavating equipment is disclosed. The assembly includes a first rotating table having a main body; one or more motors, each having a pinion, associated with the main body; a bearing having a fixed ring constrained to the main body and a movable ring that is coaxial and rotatable with respect to the fixed ring; a dragging sleeve integrally coupled with the movable ring coaxially to the bearing; a ring gear integrally and coaxially coupled with the dragging sleeve to engage with the pinion and be moved in rotation by the motors rotating integrally with the dragging sleeve and integrally with the movable ring. The assembly also has a second rotating table adapted to be coupled to a continuous excavating propeller; a plurality of accessories associated with the first rotating table so it can be coupled to a telescopic Kelly rod or to a continuous excavating propeller or to a casing and excavating pipe.

11 Claims, 9 Drawing Sheets

(51) Int. Cl.

| | |
|---|---|
| ***E02D 7/30*** | (2006.01) |
| ***E02D 5/36*** | (2006.01) |
| ***E02D 7/18*** | (2006.01) |
| ***E21B 7/00*** | (2006.01) |
| ***E21B 7/20*** | (2006.01) |

(52) U.S. Cl.
CPC ..... *E21B 7/002* (2013.01); *E21B 7/005* (2013.01); *E21B 7/021* (2013.01); *E21B 7/027* (2013.01); *E21B 7/201* (2013.01); *E02D 2250/0038* (2013.01)

(58) Field of Classification Search
CPC . E21B 7/021; E21B 7/20; E21B 7/201; E21B 3/04; E21B 3/045; E21B 3/06
USPC ..... 405/241
See application file for complete search history.

(56) References Cited

U.S. PATENT DOCUMENTS 3,754,604 A * 8/1973 Inaba ..... E02D 7/16 173/189
3,864,923 A * 2/1975 Turzillo ..... E02D 5/38 175/171
6,079,906 A * 6/2000 Herrero Codina ..... E02D 5/385 175/113
6,283,231 B1 * 9/2001 Coelus ..... E02D 5/36 175/22
2007/0253782 A1 * 11/2007 Stoetzer ..... E02D 3/08 405/241
2014/0151078 A1 * 6/2014 Bettini ..... E02D 7/00 173/1
2015/0176337 A1 * 6/2015 Ditillo ..... E02F 3/083 175/57
2015/0259871 A1 * 9/2015 Ditillo ..... E02D 15/04 405/243

OTHER PUBLICATIONS

Libebherr-Werk Nenzing Gmbh: Drilling Rig LB 44-510, XP055439280, XP055439284, pp. 2, 8-13, 2016.
Italian Search Report for Italian Application No. IT 201700024727. (2 Pages) (dated Jan. 9, 2018).

* cited by examiner 11
17
45
2c
51
9b
56
57
15b
52
40
41
39
e1
e2
t1

MODULAR ASSEMBLY FOR HANDLING EXCAVATING EQUIPMENT FOR EXCAVATING MACHINES, EXCAVATING MACHINE, METHOD FOR CONVERTING THE EXCAVATING CONFIGURATION OF AN EXCAVATING MACHINE

CROSS-REFERENCE TO RELATED APPLICATION

This application claims the benefit of Italian Patent Application No. 102017000024727 filed Mar. 6, 2017, the contents of which are incorporated herein by reference.

FIELD OF THE INVENTION

The present invention refers to a modular assembly for handling excavating equipment for excavating machines, to an excavating machine, and to a method for converting the excavating configuration of an excavating machine.

BACKGROUND OF THE INVENTION

In particular, the present invention is particularly useful in the field of excavating machines for making piles for foundations.

The technology for making piles of large diameter for foundations provides three main excavation methods, corresponding to three different excavating set-ups or configurations of the excavating machine.

The first method is LDP (large diameter pile) or drilled pile with telescopic Kelly rod or Kelly rod to which a tool of the bucket or drill type can be applied.

The second method is CFA (continuous flight auger) or perforated pile with continuous propeller provided or not with an extension sleeve.

The third method is CSP (cased secant pile) or perforated pile with cased propeller that provides excavating by moving both a continuous propeller and a casing pipe inside which the aforementioned propeller can slide.

All of the aforementioned methods provide an installation on a self-propelled excavating machine, preferably tracked and equipped with a substantially vertical guide tower equipped with suitable guides, on which rotating tables slide, adapted for generating the motion of rods, propellers and/or pipes. Different types of actuators (cable winches and/or cylinders and/or gearmotors) mounted on the machine ensure the sliding of said rotating tables along the guides of the tower (with a substantially vertical movement), so as to be able to apply downward fixing forces or upward extraction forces to said excavating means.

The three methods require machines fitted out in a very different way. The conversion of a machine to pass from one method to another is currently very onerous both in terms of time and in terms of costs for the investment in different equipment that it is necessary to replace to pass from one set-up to the other.

The method of LDP pile, thanks to the telescopic structure of the Kelly rod, can make excavations up to great depths (even up to 100 m and more) and can require the use of mud made with water and bentonite or polymers to support the walls of the excavation, because the excavation remains open for a long time (many filling cycles of the bucket are needs, and therefore it is certainly slower with respect to the excavation according to the method of CFA pile which, indeed, makes the excavation in a single stroke of the tool), because the transit repeated many times of the excavating means (bucket, drills, core drills, and so on) tends to make the walls collapse, and particularly because there are no mechanical means that support the walls of the hole. At the end of excavation, the jet of concrete to make the pile is carried out through pipes that are lowered into the excavation and that allow the concrete to be pumped from the bottom of the excavation. As the level of concrete progressively increases inside the excavation, the mud is sucked in.

As an alternative to filling the excavation through mud to ensure that the walls are supported, the hole can be supported through a coating and excavation pipe (casing) that is fixed directly by the rotating table of the excavating machine or can be fixed by an oscillating clamp or by a so-called full-rotator. In the case in which a full-rotator is used, it is arranged at the centre of the hole, generally connected to the truck of the excavating machine or even separate and hydraulically independent. The oscillating clamp or the full-rotator, through alternate oscillations or continuous movements, fix the pipe to obtain a protection of the hole for a partial or total segment of the excavation depth. If the required protection is partial and extends for a few meters or tens of meters, the insertion of the casing in the ground can be done directly with the rotating table of the excavating machine; otherwise, if the protection of the casing is required for greater depths an oscillating clamp or a full-rotator is necessary.

With reference in particular to FIG. 1A, an excavating machine of the LDP type for making piles with set-up and technology of the LDP type is shown. A supporting machine body or tower or carrier 1 that is generally tracked is equipped with a single rotating table or rotary for Kelly rods 2 that is moved in translation along a guide tower 3 that is vertical or slightly inclined on the vertical through various types of actuators like for example cable winches 6 with return pulleys, or typically hydraulic cylinders connected with a terminal to the guide tower 3 and with another terminal to the rotating table for Kelly rods 2, or gearmotors typically using a chain where the terminals of the chain are constrained to the rotating table for Kelly rods 2. A Kelly rod generally with telescopic structure having many extensions 5 crosses the rotating table for Kelly rods 2 from which it receives torque and thrust through a system of abutment strips present both on the outer surface of the rod and on the inner surface of a pipe, also called wear sleeve, present in the rotary for Kelly rods 2. In the constructive solution shown in FIG. 1A, the rotary for Kelly rods 2 is moved along the guide tower 3 through a winch 6 positioned on the tower itself, called pulling-pushing winch. The special feature of the pulling-pushing winch 6 is that of having two cables or two independent branches of a same cable on the same drum, coming out from the drum in opposite directions. One of the cables is directed towards the upper part of the tower and the other is directed towards the lower part of the tower, and through the different return sheaves present on the guide tower 3 they are both connected to the rotating table for Kelly rods 2. Preferably, one of the cables is fixed to the upper part of the rotary for Kelly rods 2 and the other is fixed to the lower part of the rotary for Kelly rods 2. In this way, when the upper cable is placed under traction by the rotation of the winch it provides the lifting or extraction pull to the rotary for Kelly rods 2 whereas when the lower cable is placed under traction by the rotation of the winch it provides the fixing thrust to the rotary 2. Since they are wound on the same drum, while one cable winds up the other unwinds and vice-versa. The pull of the pulling-pushing winch 6 on the rotary for Kelly rods 2 can be direct or transmitted to multiply the pull actually acting on the rotary for Kelly rods 2 (for example a double-tackle pull is common).

The telescopic Kelly rod 5 is, on the other hand, made to lift or release by a further manoeuvring cable 7 connected to the rod itself and that is transmitted by a head of the LDP type 4 and actuated by a further manoeuvring winch not visible in FIG. 1A since it is generally positioned in the machine body or tower 1.

However, in some possible variant embodiments such a further manoeuvring winch could be mounted on the guide tower 3. The translation movement of the rotating table for Kelly rods 2 is therefore independent from that of the rod 5 because the table of the LDP type 2 and the rod 5 are actuated by two different actuators and therefore a mutual sliding is also possible when their strips are not engaged with each other.

The telescopic Kelly rod 5 is equipped in its lower part with an attachment to be able to fix an excavation tool of the bucket (cup) or propeller drill type 8.

The rotary for Kelly rods 2 can have a structure made up according to different embodiments. In a first embodiment the rotary for Kelly rods 2 can have a monolithic bearing frame that comprises both the guide means (pads, and seats) for coupling with the guides of the tower and the return sheaves of the cables of the pulling-pushing winch 6. In a second embodiment the rotary for Kelly rods 2 can comprise a trolley that is separable from the bearing frame of the rotary for Kelly rods 2 through pin or peg systems. In this case, the trolley is equipped both with guide means (pads and seats) to couple with the guides of the tower 3 and with the return sheaves. In this case, the actuators of the pulling-pushing winch 6, i.e. the cables of the winch or the hydraulic cylinder, fix to the trolley. In a further variant, between the trolley and the bearing frame it is possible to insert a spacer than increases the distance between the axis of the pipe of the rotary and the surface of the guides. This distance is generally called "centre to centre drilling distance".

The possibility of inserting or removing the spacer thus allows to modify the centre to centre drilling distance to better adapt it to the different excavation technologies.

In any case, the rotary for Kelly rods 2 comprises a monolithic structure or frame, a dragging sleeve rotatably connected to the monolithic structure through a fifth wheel or bearings made up of an inner ring and an outer ring, a ring gear integral with the dragging sleeve, one or more motors arranged to engage with such a ring gear and arranged to carry out such a dragging sleeve in rotation, and a wear sleeve arranged to couple both with the dragging sleeve, and with a Kelly rod to transmit the rotation motion to such a Kelly rod.

In the design of the rotaries for Kelly rods, the sizing is usually carried out starting from the establishing the maximum diameter of the telescopic Kelly rod intended to be installed on a certain excavating machine. From such a value, a wear sleeve is provided that has the minimum inner diameter sufficient to house the telescopic Kelly rod and that has the smallest possible thickness to limit the required dimensions of the fifth wheel or of the bearings of the rotary. In the same way, a dragging sleeve is provided that has an inner diameter sufficient to house the wear sleeve and that has the smallest possible thickness to limit the required dimensions of the fifth wheel or of the bearings. Finally, the fifth wheel or the bearings are selected of the smallest possible size that have a passage diameter of the inner ring sufficient to house the dragging sleeve, and which have the remaining dimensions compatible with supporting the loads that will develop in the operative excavation steps. As a result of this, the difference between the inner diameter of the dragging sleeve and the outer diameter of the telescopic Kelly rod is minimal, for example a few tens of millimeters. This selection is made mainly to keep down the space occupied by the rotary and to keep down the weight of the fifth wheel or of the bearings.

The method of CFA pile, which provides for the use of the continuous excavating propeller, is used to make excavations of medium/low depth, in general up to 40 m. Drilling is carried out dry since the support of the walls of the excavation is left to the outer edge of the spire of the propeller. In order to increase the maximum depth of the pile without increasing the height of the guide tower, the so-called extension sleeve or "Kelly sleeve" is used. This accessory is an extension arranged in the upper part of the propeller, for a length of 6-8 m that is in the form of a pipe having diameter substantially equal to that of the core of the propeller, externally equipped with strips for the entire length thereof and with bayonet couplings (mechanical abutment) at the upper and lower ends, in which the dragging sleeve of the rotating table abuts. Such an accessory is mounted above the continuous excavating propeller so as to result as passing through the rotating table, and allows an increase in excavation depth equal to its length. Differently from propellers, the extension sleeve does not have spires and this causes some problems in the drilling of incoherent grounds like for example the collapsing of the walls in the excavation part without spires, and the difficulty in lifting the waste materials.

FIG. 1B shows an excavating machine of the CFA type to make piles with set-up and technology of the CFA type, in which the CFA set-up is obtained starting from the LDP version described earlier. Indeed, details and elements that are similar—or having an analogous function—to those of the drilling machine for LDP technology described earlier, are associated with the same alphanumeric references.

A supporting machine body or tower or carrier 1 that is generally tracked moves a rotating table or rotary for propellers 2*b* along a substantially vertical guide tower 3. A continuous excavating propeller 9 that is almost as long as the guide tower 3 is positioned below the rotating table for propellers 2*b* and fixed to the latter, from which it receives torque and thrust. The rotating table for propellers 2*b* can be moved along the tower in various ways: in a first way the rotating table for propellers 2*b* is moved using only the pulling-pushing winch 6 already described for the LDP set-up; otherwise, in a second way it is possible to carry out a "combined pull" by also applying to the rotary for propellers 2*b* the pull generated by an additional manoeuvring winch arranged in the supporting machine body (or possibly on the guide tower 3) that is connected to the upper part of the rotary for propellers 2*b* through the further manoeuvring cable 7.

The rotary for propellers 2*b* can be equipped with sheaves positioned in its upper part to transmit the further cable 7 and make a tackle pull (for example a double-tackle pull). Through the further cable 7 it is thus possible to apply only a pull to the rotary for propellers 2*b* but not a thrust. The pulling-pushing winch 6, on the other hand, can provide both a thrust and a pull to the rotating table for propellers 2*b*. When a "combined pull" is carried out on the propeller both the pulling-pushing winch 6 and the additional winch that commands the further cable 7 are actuated simultaneously, so as to combine their actions and obtain a sum of the pulls. A lower guide 10 fixed on the guide tower 3 and generally openable, ensures the verticality of the advancing continuous excavating propeller 9. An extension sleeve 11 with strips, equipped with two couplings at the ends, allows to increase the depth of the pile to values greater than the length of the continuous excavating propeller 9. The guide tower 3 is equipped with a head of the CFA type 4*b* suitable for CFA that could differ from the head of the LDP type 4 suitable for LDP because it could require mounting a return pulley in a more withdrawn position, in order to create sufficient space for the passage of the extension sleeve 11, or it could require that a different inclination is taken up so as to allow the extension sleeve 11 to pass. The rotating table for propellers 2*b* differs slightly from the rotating table for Kelly rods 2 due to the presence of a diameter adapter sleeve that is inserted in the rotating table for propellers 2*b* and that allows this extension sleeve 11 to be used to connect to the continuous excavating propeller 9.

The method of CSP pile is used mainly to carry out mutually adjacent or secant piles. When it is wished to carry out a sequence of piles, all intersecting, so as to form a sort of diaphragm or partition in the ground, this CSP technology is adopted carrying out a suitable process. The process provides that firstly a series of holes are carried out, called primary holes placed aligned at a certain distance to each other, and that thereafter a second series of holes are carried out, called secondary holes that are arranged in the interspaces between the primary holes already made, and intersect them for small portions. Of course, the holes for the secondary piles are carried out when the primary piles have already solidified, therefore the propeller as well as the ground must also excavate the cement of the portion of the volume of the primary piles that is intersected by the secondary piles.

Precisely for this reason, the secondary piles tend to deviate their path from the area with hardened concrete towards those with ground or soft concrete, jeopardising the rectilinear nature of the diaphragm and the intersection with the primary piles, i.e. the continuity of the diaphragm. It is for this reason that the coating and excavating pipe or casing is used, which ensures the rectilinear nature of the pile: indeed, the pipe cuts the concrete of the primary piles, and the continuous excavating propeller, which is kept a few centimeters back with respect to the pipe, excavates the ground and lifts the debris.

Sometimes, on the other hand, it is advantageous to keep the continuous excavating propeller in an advanced position projecting with respect to the casing and excavating pipe to load the incoherent material; also in this case the pipe conserves its guide function to prevent the continuous excavating propeller from tending to flex given its low rigidity. The CSP technology provides the use of a rotating table for propellers adapted for moving the continuous propeller and a rotating table for pipes arranged on the same guides of the tower below the rotating table for propellers and coaxial to it. This rotating table for pipes is equipped with lifting or lowering means that are independent with respect to the rotating table for propellers and drags in translation and in rotation a casing and excavating pipe having diameter such as to contain the continuous excavating propeller. The rotary for pipes must also have an inner passage such as to allow the crossing of the propeller. The rotary for pipes, commonly called "intubator", imparts a rotation to the casing and excavating pipe, preferably in the reverse direction to that of the continuous excavating propeller, and a thrust downwards. The continuous excavating propeller thus excavates a hole the walls of which are supported by the casing and excavating pipe.

The technology of CSP pile in the field of construction is also called CFA cased pile technology.

Moreover, there are applications known in the field of foundations for which the linear movement systems of the rotaries along the guide tower are not independent from one another like those of the type described up to now. There are variants in which one of the two rotaries is connected to a first movement system, for example a winch with direct or transmitted cables, whereas the other rotary, generally the rotary of the propeller, is equipped with a second movement system through linear actuators, generally hydraulic cylinders, which, when actuated, move one rotary with respect to the other and consequently move the continuous excavating propeller linearly with respect to the casing and excavating pipe. Generally, this movement is limited to an excursion that varies between 200 and 600 mm and allows a simpler but much more restrictive set-up during the excavation steps. One of the limitations of this solution is for example the fact that it is impossible to completely extract the continuous excavating propeller before the casing and excavating pipe is extracted. In this last constructive solution, the two rotaries can be mounted on the same trolley, in any case being able to have relative sliding, or they can be mounted on two independent trolleys. Again, in this solution, the movement system of the rotary that uses a winch preferably exploits a winch having a double branch to carry out both the extraction pulling through the upper branch and the fixing thrust through the lower branch.

In a further known variant, described in EP2048321B1, the encased propeller drilling system is made through a single rotary mechanically connected to a torque or revolution multiplier which in turn moves both the propeller and the pipe in rotation. The multiplier receives in input the torque and the rotation provided by the rotary and has the possibility of providing in output a rotation of the propeller in the clockwise direction and a simultaneous rotation of the pipe in the anti-clockwise direction.

With reference to FIG. 1C an excavating machine of the CSP type is illustrated with CSP set-up defined as standard. Details and elements that are similar—or having an analogous function—to those of the drilling machine for LDP or CFA technology described earlier, are associated with the same alphanumeric references. A generally tracked supporting machine body or tower or carrier 1 comprises a vertical guide tower 3 along which a rotating table or "rotary" for propellers 12 slides. A continuous excavating propeller 9 (not visible in this figure because hidden by the pipe) of slightly shorter length than that of the guide tower 3 is fixed to the rotating table for propellers 12, from which it receives torque and pulling or pushing forces to generate the sliding with respect to the tower 3.

The rotating table for propellers 12 is moved along the tower by a first manoeuvring winch not visible from the images because it is positioned in the machine body or tower. It is nevertheless possible to see the cable 7 coming out from such a winch, which is then transmitted in a head of the CSP type 16 arranged at the upper end of the guide tower 3. In the case in which through the cable 7 it is wished to carry out a multiple tackle pull applied to the rotary for propellers 12, suitable transmission means such as pulleys and blocks can be installed integrally to the rotating table for propellers 12. As movement means of the rotary for propellers 12 it is in any case possible to use actuators equivalent to the winch with cable, for example a motor equipped with a pinion that acts on a chain connected to the rotary. An extension sleeve 11 equipped with strips and with two attachments at the ends increases with its length the maximum executable depth of the pile. A rotating table or "rotary" for pipes of the CSP type 13 arranged under the rotary for propellers 12 is moved by a second pulling winch 14 and slides on the same guide tower 3 in a preferably independent manner from the rotary for propellers 12, thanks to the action of separate pulling and pushing means. The rotary for pipes of the CSP type 13 commonly called "intubator" is characterised by a large inner passage capable of housing the diameter of propeller 9 fixed under the rotary for propellers 12. This characteristic of allowing the crossing of the propeller, essential for the operation of CSP technology implies for the intubator 13 a considerable space and weight. A coating and excavation pipe or casing 15 sized to be able to contain the bulk of the continuous excavating propeller 9 is fixed under the intubator 13 from which it receives torque and thrust.

Such a casing and excavating pipe 15 is equipped with excavating teeth in its lower part and excavates a "core" in the ground that is immediately broken up by the coating and excavation propeller 9 kept slightly back with respect to the lower edge of the pipe 15. A lower guide 10 equipped with a passage coaxial to the axis of the rotaries 12 and 13 and fixed on the guide tower 3 that is generally openable ensures the verticality of the pipe in the first excavation steps keeping the lower part of the pipe aligned with the excavation axis.

The intubator 13 is created to work with rotation speed of a few revs per minute (maximum 5-10 rpm) and with a lot of torque, precisely because it drags pipes of great diameter that thus have a lot of friction surface with the ground. The torque curve of an intubator developed as a function of the rotation speed can be considered substantially flat; this means that the intubator provides the maximum torque both at the minimum rotation speed and at the maximum rotation speed. In the construction of intubators preference is given to the use of toothed fifth wheels of large dimensions, since the high circumference allows to arrange many teeth that couple with the pinions of the motors and allow to obtain high reduction ratios that make it possible to increase the torque produced. Given the low rotation speed a greasing of the gears is sufficient, which can be installed in a housing that is open at the bottom to allow greasing.

Otherwise, the rotary for the movement of Kelly rods or of continuous propeller, like the rotary for propellers 12, is created to have a more extensive and variable torque curve along the axis of the graph that expresses the rotation speed, i.e. a wider working range. In particular, the rotary for propellers or Kelly can work at low revolutions developing high torques (therefore a first segment of the torque graph will be flat) and then it can progressively increase the rotation speed at the expense of a reduction of torque developed (therefore the torque graph will progress like a descending parabola) until a high speed (for example up to 30-40 rpm) and low torque work condition is reached.

Therefore, the torque curve of a rotary for propellers or for rods could incorporate the torque curve of an intubator (for the same maximum torque able to be delivered) but not vice-versa, since the intubator can only reach a limited number of revs per minute.

This means that a rotary for propellers or Kelly rods could be made to work at the low rotation speeds typical of an intubator (5-10 rpm) with high torque, whereas an intubator cannot be made to work at high rotation speeds typical of excavation with propeller or Kelly rod.

This variability of the possible work conditions of the rotary is obtained thanks to some technical provisions in the construction of the rotary itself, like for example the presence of variable displacement motors, and the possibility of having a mechanical gearbox to modify the gears as the required speed or torque varies. Given the high rotation speeds required, in the rotaries for the movement of Kelly rods or for propellers, the inner gears (pinions of the motors and ring gear of the fifth wheel) are made to work in an oil bath. For this reason, they are installed in a housing arranged to be filled with oil (called "rotary case") and equipped with sealing gaskets, as well as doors for loading and emptying the lubricating oil. The rotaries for the movement of Kelly rods or for propellers, like the rotary for propellers 12, are equipped with a further motor having high rotation speed called spin-off motor that is actuated during particular steps of the excavation. When excavation is carried out using a drill connected to Kelly rods as the tool, once the drill has been filled with excavated ground it is necessary to extract it from the excavation and unload the debris. The unloading step takes place by engaging the spin-off motor and actuating it for a short period. The spin-off motor acts by quickly rotating the drill in the opposite direction to that of winding of its spires, with a rotation speed that can vary from 50 to 150 revs per minute based on the size of the tool and of the rotary.

In this way, the centrifugal force pushes the debris to come out from the spaces between the spires, emptying the drill and falling to the ground.

It is known that rotating tables for Kelly rods can be converted into rotation tables for propellers; such conversion takes place by mounting in the rotary for Kelly rods an adapter adapted for reducing the inner passage of the rotary for Kelly rods and adapting it to the diameters of the extension sleeves used for mounting the continuous propellers. This reduction of the passage is necessary since the telescopic Kelly rods currently on the market generally have an outer diameter comprised between 324 and 630 millimeters, and preferably comprised between 355 mm and 558 mm, whereas the extension sleeves connected to the upper end of the continuous propellers generally have an outer diameter comprised between 150 and 356 millimeters.

In the prior art, an excavating machine of the LDP type like the one shown in FIG. 1A can be transformed or converted in an excavating machine of the CFA type like the one shown in FIG. 1B by modifying the rotary for Kelly rods 2 as described above, i.e. through the insertion of an adapter in the rotary for Kelly rods 2 in order to obtain a rotary for propellers 2*b* suitable for dragging the propeller. Of course, for the transformation it is also necessary to dismount the telescopic Kelly rods 5 and replace them with a continuous excavating propeller 9 obtaining the set-up shown in FIG. 1B. The rotary for Kelly rods and the rotary for propellers have substantially the same weight and the same performance in terms of torque and revs; therefore, the rotary for Kelly rods is substantially the same as the rotary for propellers except for the diameter adapter. In particular, these rotaries are generally selected of the maximum possible size to maximise the excavation performance of the machine, and such a selection is based on the respect of the maximum installable weight on the guide tower without compromising the frontal stability and on the respect of the structural resistance to torsion and flexing of the guide tower. Indeed, the rotary is positioned canti-levered with respect to the support surface provided by the tracks, and in a raised position with respect to the supporting machine body that can also reach the upper end of the guide tower; therefore, a rotary of excessive weight and size could cause the machine to tip over at the front or in any case insufficient stability for safety purposes.

If, starting from an excavating machine of the LDP type like the one shown in FIG. 1A, it is wished to modify its set-up to transform it into a standard excavating machine of the CSP standard type shown in FIG. 1C, it would not be possible to continue to use the rotary for Kelly rods 2 to move the continuous propeller for the CSP set-up, but it should be replaced with a rotary for propellers 12 of lesser size and weight. This replacement becomes necessary in known (standard) machines precisely so as not to compromise stability.

The standard method for the set-up in CSP version requires the addition of a known intubator 13 that as stated is heavier than the rotary for Kelly rods 2. In order to compensate for this increase in weight, generally the rotary for Kelly rods of the LDP type 2 is dismounted and it is replaced with a smaller and lighter rotary for propellers 12 for the movement of the propeller, while the intubator 13 moves the pipe/casing.

The reversible conversion of a machine of the LDP type of FIG. 1A into a standard machine of the CSP type of FIG. 1C requires the provision of two rotating tables, a first table for Kelly rods of the LDP type 2 of greater size and weight, a second table for propellers 12 of lower size and weight and a third table for pipes or intubator 13. Such additional components generally have substantial costs.

It should also be specified that in the standard CSP set-up, in order to maximise the performances of the machine in terms of extraction force of the propeller, the head of the CSP type 16 is also generally very different both from the head of the LDP type 4 and from the head of the CFA type 4*b* used in the CFA set-up of FIG. 1B obtained starting from the LDP set-up. Indeed, the head of the CSP type 16 is equipped with a greater number of pulleys, arranged differently and suitable for multiplying the pull of the manoeuvring winch associated with the machine body and the manoeuvring cable 7 of which is visible. Said multiplication in practice performs a multiple pull (generally a fourth-tackle pull) through a suitable "turning of the cables" on the pulleys of the guide tower and of the rotary, so that for the same pull provided by the winch a multiplied force is obtained that acts by lifting on the rotary and therefore on the propeller.

As is clear, the transformation of the LDP type machine into a Standard CSP machine according to known methods is very onerous both in terms of cost and in terms of time necessary for the transformation given that the two machine set-ups are substantially different. Major replacements of mechanical parts are necessary, which require the dismounting and remounting of various components also with regard to the hydraulic systems relative to the actuation of the rotaries.

The conversion of the standard LDP type machine (FIG. 1A) into a standard CSP type machine (FIG. 1C) according to the method used up to now in the prior art provides the following modification steps of the set-up:

a. dismounting the LDP 4 type head arranged for the first tackle pull; this also requires disconnecting the cable 7 from the rotary for Kelly rods 2 and unwinding it (disengaging it) from the pulleys of the LDP 4 type head.

b. mounting the head of type CSP 16, which has a different geometry and is arranged for fourth-tackle pull; in such a step it is necessary to rewind the manoeuvring cable 7, with a different turn with respect to that which it did with the LDP 4 type head, on the pulleys of the CSP 16 type head and on the pulleys arranged in the upper part of the rotary for Kelly rods 2.

c. dismounting the rotary for Kelly rods 2 from the guide tower 3 (and if it is equipped with a trolley it is also necessary to dismount the trolley) and undoing the cable turns that come from the pulling-pushing winch 6, i.e. disconnecting the cable from the rotary for Kelly rods 2 and unwinding it (disengaging it) from the pulleys of the rotary 2 or of its trolley.

d. mounting on the guide tower 3 the rotary for propellers 12 of smaller size, equipped in its upper part with blocks and pulleys suitable for fourth-tackle pull to be connected (engaged) to the manoeuvring cable 7 coming from the manoeuvring winch mounted on the tower.

e. installing pipes and systems for the new rotary for propellers 12, which is fed hydraulically or with another energy source.

f. mounting on the guide tower 3 the intubator 13 and the relative cleaning and debris-unloading means positioned over the intubator; in particular, in this step a cleaner (preferably using rollers) is mounted below the rotary for propellers 12.

g. installing the pipes and the systems for the intubator 13; such pipes are not the same ones used for the rotary for Kelly rods 2, since the intubator 13 requires different flow rates and oil pressures, and can have a different number of motors, as well as being able to have many actuators for additional functions with respect to the rotary.

h. dismounting the pulling-pushing winch 6 arranged for pulling-pushing with a cable that extends along two branches, an upper one and a lower one, and mounting the pulling winch 14 that can carry out only the pulling with a single cable that extends along a single upper branch.

i. connecting the cable of the pulling winch 14 to the trolley of the intubator 13 suitably making the "cable turns".

As well as the steps listed above it is necessary to dismount the Kelly rods and install the continuous excavating propeller and the casing and excavating pipe and other steps of lesser relevance that will not be discussed further in the present description.

It should be emphasised that the replacement operations of the head are very long and complex. Indeed, in order to be able to move these heads weighing a few hundred kilos it is necessary to have an auxiliary crane.

Moreover, it is necessary to unscrew all of the bolted connections, dismount the head, position the new head and screw all of the connections back in.

It may therefore be the case that one same excavating machine, when set up according to LDP technology to be used with Kelly rods, mounts a rotary for Kelly rods 2 and when set up according to CSP technology mounts an additional intubator 13, of substantially greater size and weight than the rotary for Kelly rods 2, and a light upper rotary for propellers 12 replacing the rotary for Kelly rods 2. Therefore, in the prior art up to 3 rotating tables are necessary in order to be able to ensure the maximum technological flexibility, i.e. the possibility of modifying the set-ups, and the maximum performance, with clear worsening of costs.

SUMMARY AND OBJECT OF THE INVENTION

The purpose of the present invention is that of avoiding the aforementioned drawbacks and in particular that of devising a modular assembly for handling excavating equipment relative to different excavation methods that allows to reversibly modify, in a simpler, quicker and cheaper manner with respect to the prior art, the excavating configuration of an excavating machine.

A further purpose of the present invention is that of devising a method that allows to modify the excavating configuration of an excavating machine by changing the relative excavation method thereof in a simple, quick and cost-effective manner.

Yet another purpose of the present invention is to make an excavating machine set up with cased continuous propeller.

These and other purposes according to the present invention are accomplished by making a modular assembly for handling excavating equipment, a method for converting the excavating configuration of an excavating machine, and an excavating machine as outlined in the independent claims.

Further characteristics of the modular assembly for handling excavating equipment, of the method for converting the excavating configuration of an excavating machine, and of the excavating machine are the object of the dependent claims.

BRIEF DESCRIPTION OF THE DRAWINGS

The characteristics and advantages of a modular assembly for handling excavating equipment, a method for converting the excavating configuration of an excavating machine, and an excavating machine according to the present invention will become clearer from the following description, given as an example and not for limiting purposes, referring to the attached schematic drawings, in which.

DETAILED DESCRIPTION OF THE INVENTION

Figure 1C:
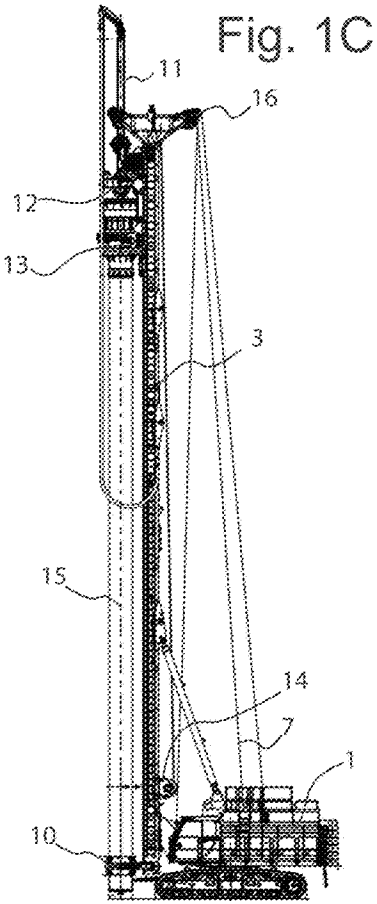
Prior Art Fig. 1C
FIG. 1C is a schematic view of an excavating machine set up for the standard CSP excavation method according to the prior art.

With reference to the figures, a modular assembly for handling excavating equipment for excavating machines for making excavated piles is shown.

Such a modular handling assembly comprises a first rotating table or rotary 2*c*, a plurality of accessories 27, 29, 31 able to be associated with the first rotating table 2*c* so it can be selectively coupled to a telescopic Kelly rod or Kelly rod 5, or with a continuous excavating propeller 9, 9*b*, 9*c* or with a casing and excavating pipe 15,15*b* and 15*c*, and a second rotating table or rotary 17 adapted for being coupled with a continuous excavating propeller 9, 9*b*, 9*c*.

The modular handling assembly, according to the present invention, can be set up in a different manner by equipping the first rotating table 2*c* with the accessories adapted for making it suitable for coupling with the different excavating equipment.

Figure 3:
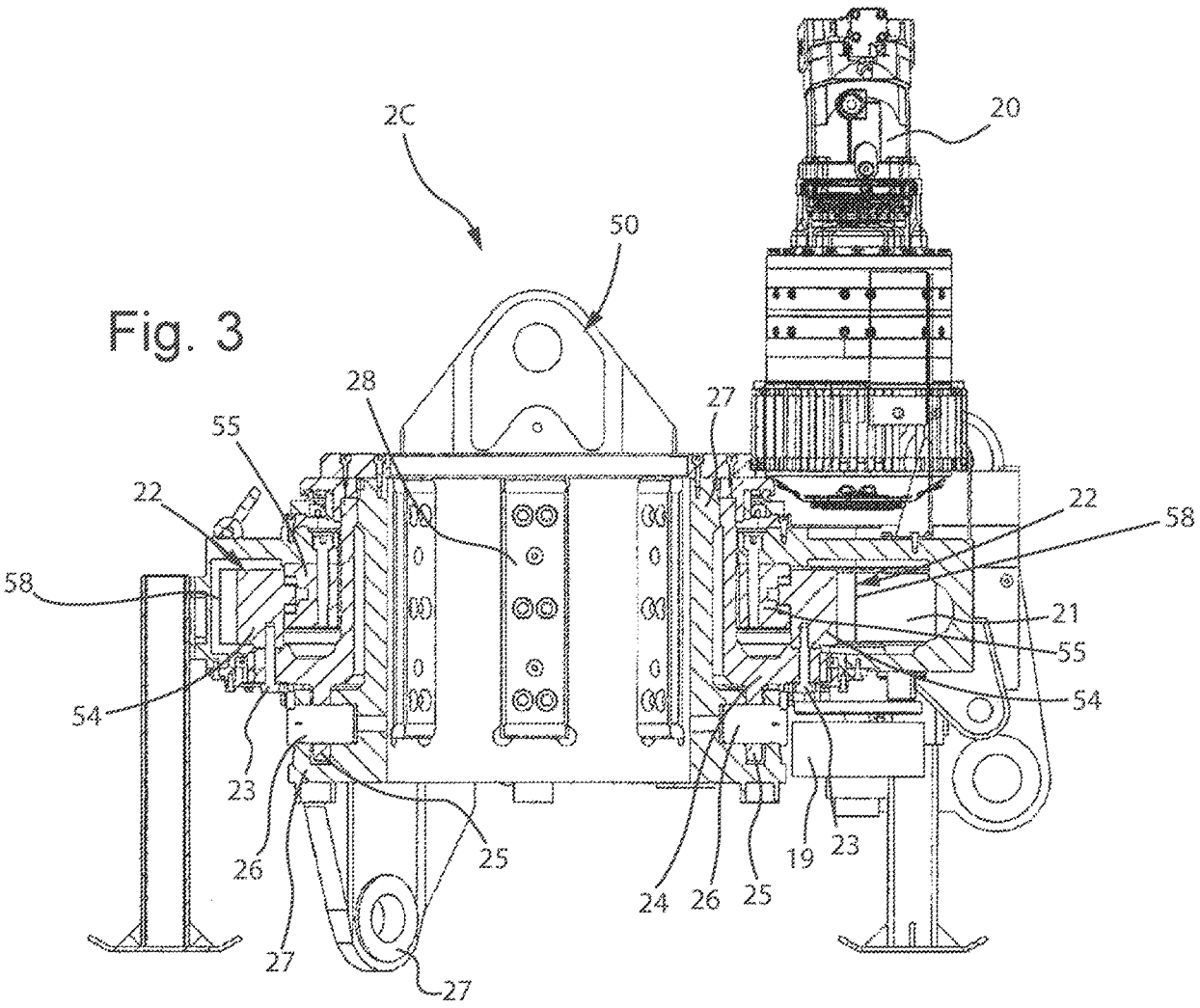
FIG. 3 is a schematic section view of a first rotating table in an LDP configuration of a modular handling assembly according to the present invention.
Figure 4:
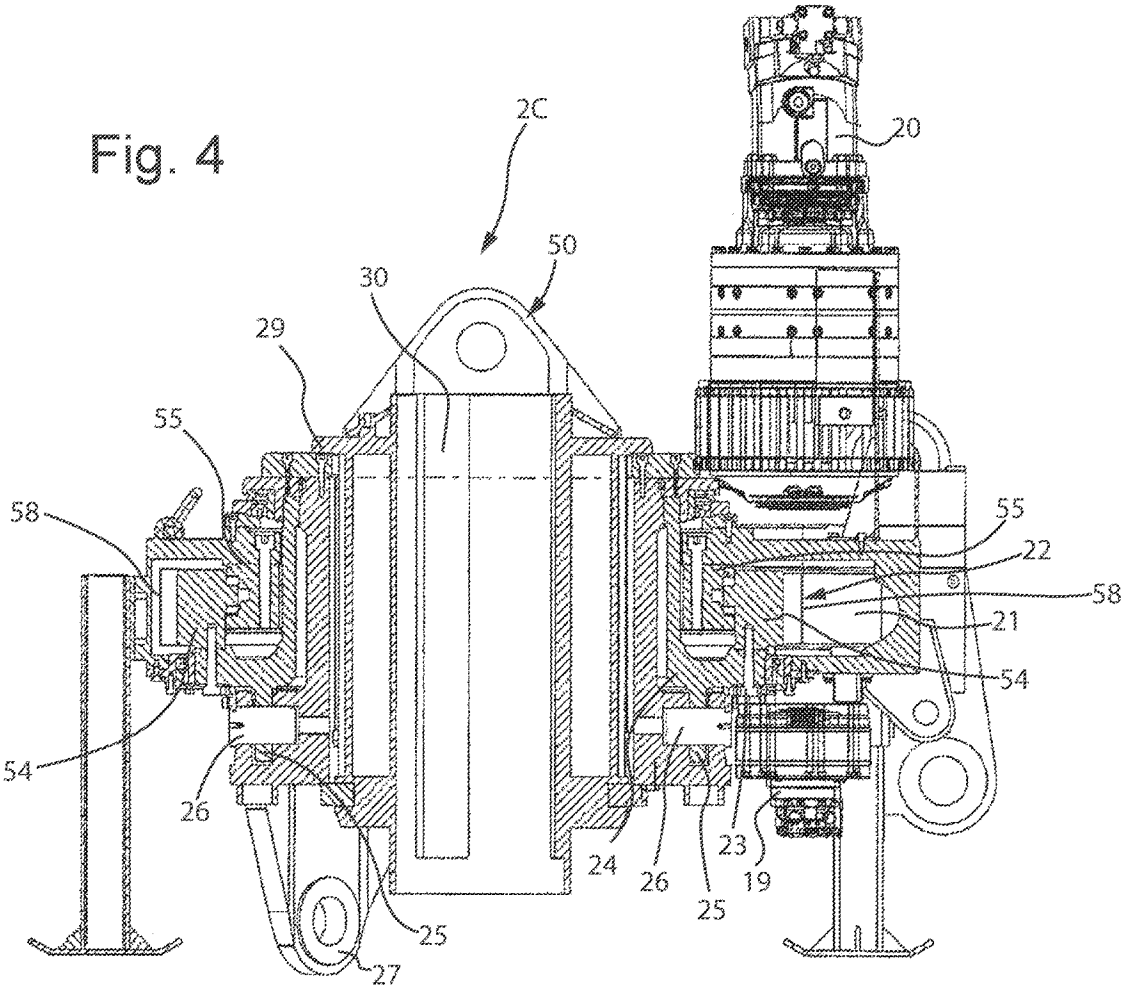
FIG. 4 is a schematic section view of a first rotating table in a CFA configuration of a modular handling assembly according to the present invention.
Figure 5:
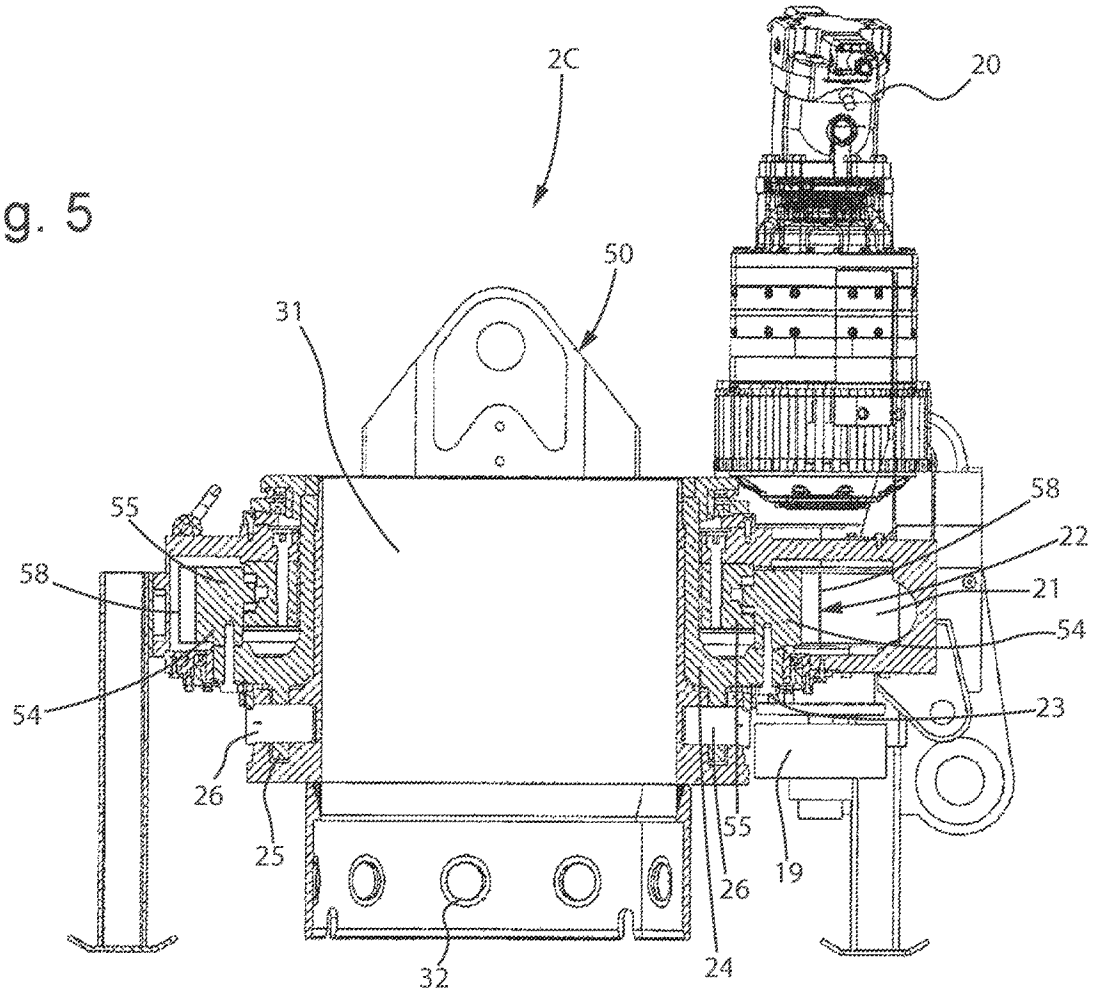
FIG. 5 is a schematic section view of a first rotating table in a CSP configuration of a modular handling assembly according to the present invention.

FIGS. 3, 4 and 5 show the first rotary 2*c* in LDP, CFA and CSP configuration, respectively. The first rotating table 2*c* comprises a main body or carcass 50, a sleeve 24 commonly called "dragging sleeve" rotatable with respect to such a main body 50, at least one bearing 22 arranged coaxial to the dragging sleeve to rotatably connect such a sleeve to the monolithic structure of the rotary, a toothed wheel or crown 58 integral with the dragging sleeve 24, one or more main motors 20 each of which is equipped with a pinion 21, said pinion being arranged to engage with such a toothed wheel or crown 58, directly or through further intermediate toothed wheels that form reduction stages, to move such a ring gear 58 and such a dragging sleeve 24 in rotation.

In the embodiment of the first rotating table 2*c* shown in FIGS. 3, 4 and 5 the dragging sleeve is rotatably connected to the monolithic structure of the rotary through the at least one bearing 22, which in this particular embodiment is a fifth wheel 22 made up of a fixed ring 55 and a movable ring 54 that is coaxial and rotatable with respect to said fixed ring 55. The fixed ring 55 is internal, i.e. in a position closer to the rotation axis of the fifth wheel, and constrained to the main body or carcass 50 so as to remain stationary with respect to it. The movable ring 54 is external, i.e. in a position further from the rotation axis of the fifth wheel, and is bolted through multiple screws 23 to the dragging sleeve 24, so as to be integral with the dragging sleeve 24 and rotating with respect to the main body or carcass 50. In the embodiment shown in FIGS. 3, 4 and 5 the ring gear 58 is made directly on the movable ring 55 of the fifth wheel 22 and is integral with it, i.e. the ring gear 58 is made through a toothing on the movable ring 54. Since the movable ring 54 is integral with the dragging sleeve 24, the wheel or ring gear 58 is also integral and coaxial to the dragging sleeve and therefore when the main motors 20 set the ring gear 58 in rotation, the dragging sleeve 24 is also set in rotation.

In an alternative embodiment of the first rotating table 2*c*, the dragging sleeve 24 can be rotatably connected to the monolithic structure 50 of the rotary through two or more bearings 22, coaxial to the sleeve and axially spaced, each of which is made up of a fixed ring 55 and a movable ring 54 coaxial and rotatable with respect to said fixed ring. The fixed ring 55 of each bearing 22 is constrained to the main body or carcass 50 in suitable seats so as to remain stationary with respect to it and the movable ring 54 is constrained to the dragging sleeve 24 in suitable seats, so as to rotate as a unit with the dragging sleeve 24 and rotating with respect to the main body or carcass 50. In this case the toothed wheel 58 is a distinct component from the bearings 22, and is arranged coaxial and external to the dragging sleeve 24 and integrally constrained to it, for example through bolting or making the toothing 58 directly on the outer part of the dragging sleeve 24. Preferably, such a ring gear 58 is arranged axially between two bearings 22 axially spaced one to each other.

Moreover, it should be understood that the main motors 20 of the first rotating table 2*c* can be of various types, preferably hydraulic for example of the orbital or piston type (axial and/or radial) or a combination thereof, but they could also be electric. Moreover, the main motors 20 can couple directly with the final reduction stage of the first rotating table 2*c*, i.e. with the toothed wheel 58 that moves the dragging sleeve 24, or can be connected to a reducer arranged between the motor and said toothed wheel 58 to reduce the speed and multiply the torque coming out from such motors.

The dragging sleeve 24, once the first rotating table 2*c* is mounted on the excavating machine, is therefore mounted coaxial to the excavation axis and can rotate about such an axis with respect to the main body 50 of the first rotary 2*c*.

The dragging sleeve 24 is equipped, in its lower part, with a plurality of ear elements 25 to which, through pins 26, specific accessories suitable for the predetermined excavation type, i.e. LDP, CFA, or CSP, can be fixed.

The first rotary 2*c*, as shown in FIG. 3, is set up to be coupled with a telescopic Kelly rod, i.e. it is equipped with a first accessory 27 of the aforementioned accessories, specific for a telescopic Kelly rod. Such an accessory is a further sleeve 27 called wear sleeve for Kelly rods 27, arranged to be coupled integrally and coaxially with said dragging sleeve 24 and to transmit the rotary motion to a Kelly rod. In particular, the wear sleeve for Kelly rods 27 is inserted in the main body 50 of the first rotary 2*c* coaxially in the dragging sleeve 24 and made integral with it through a plurality of pins 26. Such pins 26 engage in the ear elements 25 of the dragging sleeve 24 and in corresponding recesses present on the wear sleeve for Kelly rods 27. The wear sleeve for Kelly rods 27 is thus dragged in rotation by the dragging sleeve 24 when the latter is actuated by the main motors 20. The wear sleeve for Kelly rods 27 has an inner cylindrical passage that allows a telescopic Kelly rod 5 to be inserted and has the function of transmitting the rotary motion and the axial forces to the telescopic Kelly rod 5. For this purpose, the wear sleeve for Kelly rods 27 is equipped in its inner surface with a plurality of strips 28 welded or bolted to the sleeve itself, which transmit torque and thrust to the telescopic Kelly rod 5 through friction or mechanical abutment on corresponding outer strips of the telescopic Kelly rod. The wear sleeve for Kelly rods 27 must also allow, in some conditions, the axial sliding of the telescopic Kelly rod 5 with respect to the first rotary 2*c*. Such sliding indeed generates the wearing of the wear sleeve for Kelly rods 27 and of its strips 28, for which reason such parts are removably constrained to the first rotary 2*c* to be able to be easily replaced when excessively worn. In the lower part of the first rotary 2*c* a spin-off motor 19 is also installed. The spin-off motor 19, through a pinion mounted on its own outlet shaft engages with the ring gear, thus being able to contribute to the rotation of the dragging sleeve 24.

Preferably, the shaft of the spin-off motor 19 is engaged with the same pinion 21 with which the main motor 20 is also engaged.

The spin-off motor 19 is arranged to develop low torques and high rotation speeds at its outlet shaft.

It should also be understood that the spin-off motors 19 of the first rotating table 2*c* can be of various types, preferably hydraulic for example of the orbital or piston type (axial and/or radial) or a combination thereof, but they could also be electric.

During the excavation steps the spin-off motor 19 can preferably contribute to providing torque to the dragging sleeve 24 collaborating with the main motors 20. In order to carry out the step of unloading the debris from the excavation tool at the end of the excavation step, the operator in the cabin can actuate a command, for example a button or a lever, to activate the spin-off function. When the command is actuated, a hydraulic circuit of the first rotary 2*c* is pressurised which causes the disengagement of the shaft of each main motor 20 from the respective pinion 21. At the same time, the spin-off motor 19 is actuated imparting a very fast rotation, which can reach 150 revs per minute, to the dragging sleeve 24 and to the telescopic Kelly rod 5 with opposite rotation direction to that of excavation. In this way, the debris by centrifugal effect detaches from the excavation tool and falls to the ground. The main motors 20 during the spin-off step are disengaged since they are unable to reach such rotation speeds and therefore should be dragged by the spin-off motor 19 and would act as a brake opposing resistance to rotation. Therefore, by releasing them the force required to the spin-off motor 19 is reduced.

An alternative solution is that by which the spin-off motors 19 are coupled with the ring gear 58 with independent pinions. The spin-off motors 19 could also be connected indirectly to the ring gear 58, through further intermediate toothed wheels that form reduction stages. In the case of spin-off motors with high displacement, typically radial piston motors, the spin-off speed is reached by adjusting the displacement of one or more of the motors present on the rotary so as to reduce it. This displacement reduction causes a proportional increase in speed, sufficient to carry out the cleaning of the tool.

FIG. 4 illustrates the first rotating table 2*c* set up for the CFA excavation method. Such a set-up provides the use of a second accessory 29 of the aforementioned accessories, in addition to the wear sleeve for Kelly rods 27, in order to make the first rotary 2*c* associable with a continuous excavating propeller. Such a second accessory is a diameter adapter sleeve for propellers 29 arranged to be coupled integrally and coaxially with the wear sleeve for Kelly rods 27 and to transmit the rotary motion to a continuous excavating propeller 9, 9*b*, 9*c*. Such a diameter adapter sleeve for propellers 29 has a substantially cylindrical shape, is inserted coaxially inside the wear sleeve for Kelly rods 27 and is constrained to it so as to be dragged in rotation. Such a diameter adapter sleeve 29 reduces the inner passage of the first rotary 2*c* so as to allow the direct or indirect coupling through the extension sleeve 11 with the continuous excavating propeller 9, 9*b*, 9*c*; the core of the continuous excavating propeller and the extension sleeve 11, indeed, have an outer diameter substantially smaller than the outer diameter of the telescopic Kelly rod 5 that is used for the LDP excavation method. The diameter adapter sleeve 29 has an inner diameter typically comprised between 150 millimeters and 356 millimeters. In particular, the diameter adapter sleeve 29 has the inner and outer surfaces of the cylindrical body equipped with vertical strips (not illustrated), adapted for engaging with the strips 28 of the wear sleeve for Kelly rods 27 to receive the rotation motion from the latter. The diameter adapter sleeve 29 also has inner strips 30 adapted for engaging with the extension sleeve 11 or with the continuous excavating propeller to drag them in rotation.

FIG. 5 illustrates the first rotating table 2*c* set up for the CSP excavation method.

Such a set-up provides the use of a third accessory 31 of the aforementioned accessories, replacing the wear sleeve for Kelly rods 27, in order to make the first rotary 2*c* suitable for the coupling and the dragging of a casing and excavating pipe.

Such a third accessory 31 is a sleeve 31 also called wear sleeve for intubator 31 arranged to be coupled integrally and coaxially with the dragging sleeve 24 and to transmit the rotary motion to a casing and excavating pipe 15, 15*b*, 15*c*. Such a wear sleeve for intubator 31 is inserted coaxially in the inner passage of the dragging sleeve 24 and is constrained to it through the pins 25 that engage both in the ear elements 25 of the dragging sleeve 24 and in the corresponding recesses arranged on the wear sleeve for intubator 31. The wear sleeve for intubator 31 is made with a minimum thickness, substantially comparable to the thickness of the drilling pipe or casing to which it will be connected, and this selection allows to maximise the inner passage diameter of the sleeve, i.e. to maximise the diameter of the propeller that can cross the first rotary 2*c*. The wear sleeve for intubator 31 has a plurality of seats 32 at the bottom for the insertion of screws, or pins or in any case means suitable for the transmission of the torque and of the rotary motion to the casing that will be connected to such a sleeve 31. The wear sleeve for intubator 31 extends longitudinally along the rotation axis of the first rotary 2*c* crossing it completely and extending at the bottom so as to allow the connection to the casing. Moreover, the wear sleeve for intubator 31 extends above the main body of the first rotary 2*c* so as to allow the ground rising between the coating and excavation casing and the continuous excavating propeller to be guided, when the first rotary 2*c* is used as intubator; thus, the debris comes out on top of the first rotary 2*c* and is unloaded towards the ground.

Once connected to the coating and excavation casing 15, 15*b*, 15*c* the wear sleeve for intubator 31 constitutes an extension of the casing 15,15*b*, 15*c* having substantially the same inner diameter and the same thickness. It is thus possible to say that the first rotary 2*c* modified to act as intubator is crossed longitudinally both by the coating and excavation casing and by the continuous excavating propeller.

Advantageously, the first rotary 2*c* according to the present invention is designed differently with respect to known rotaries, attempting to obtain an inner passage diameter of the first rotary that is as large as possible with minimum increases in the external dimensions of the first rotary 2*c*. The maximisation of the inner passage is particularly advantageous when such a first rotary 2*c* is used as intubator, since it allows the passage of propellers having a large diameter through the first rotary 2*c*.

The first rotary 2*c*, therefore, has a fifth wheel 22 with larger inner passage with respect to the minimum required, or in any case with respect to the fifth wheel diameter that would have been selected up to now with the design methods of the prior art. In particular, the first rotary 2*c* comprises a main body analogous to that of the known rotaries for Kelly rods; considering the dimensions of such a main body, the fifth wheel 22 has an outer diameter that is as large as possible and a minimum radial thickness so as to obtain the inner diameter of the fifth wheel that is as large as possible. These considerations on the sizing of the fifth wheel 22 can also be applied to the case in which the first rotary 2*c* has two or more bearings axially spaced one to each other. The dragging sleeve 24 has the maximum outer diameter that still allows it to be inserted inside the passage of the inner ring of the fifth wheel 22. The dragging sleeve 24 is then made with minimum thickness, in order to maximise the inner passage diameter. In this way, a dragging sleeve 24 with a very large inner diameter with respect to the outer diameter of a telescopic Kelly rod is obtained.

For example, considering the case of a first rotating table 2*c* for a Kelly rod having a diameter of 558 mm, the inner diameter of the dragging sleeve 24 can vary between 700 millimeters and 800 millimeters, preferably between 730 and 750 millimeters while the outer diameter of the telescopic largest Kelly rod provided for such a first rotary 2*c* and able to be coupled with the dragging sleeve of such dimensions is of the order of 558 mm. This thus results in a ratio between these two diameters that reaches values comprised between 1.25 and 1.5, and preferably comprised between 1.31 and 1.34.

Consequently, in order to compensate for the large difference between the diameters of the telescopic Kelly rod and of the dragging sleeve 24, the wear sleeve for Kelly rods 27 has walls of great thickness. As a result of this, in the first rotary 2*c* set up like FIG. 3, by taking off the wear sleeve 27 an increase in the inner passage diameter of the rotary is obtained that is much greater than the increase that would usually have been obtained in known or conventional rotaries by taking off the known wear sleeve.

Therefore, for use according to the CSP excavation it proceeds taking off the wear sleeve for Kelly rods of large thickness 27 and to insert a wear sleeve for intubator 31, which has a minimised thickness and a maximised inner passage of about 740 mm. A ratio is thus obtained between the inner passage of the wear sleeve for intubator and the maximum diameter of the telescopic Kelly rod able to be dragged by the first rotary 2*c* comprised between 1.3 and 1.4, preferably equal to about 1.32.

As a result of this the first rotary 2*c* set up for CSP excavation method manages to drag a casing and excavating pipe with outer diameter of 800 mm and inner diameter of 740 mm, and allows the passage of an propeller of large diameter, equal to 700-730 mm, through the rotary itself.

The modular assembly for handling excavating equipment, according to the present invention, can be applied in the three different set-ups described above to an excavating machine to obtain a first configuration for pile drilled with telescopic Kelly rod i.e. for the LDP type excavation method, or a second configuration for pile drilled with continuous excavating propeller i.e. for CFA type excavation method, or a third configuration for pile drilled with cased continuous propeller i.e. for CSP type excavation method. In particular, the third configuration of the excavating machine that can be obtained through the aforementioned modular handling assembly is called configuration for quick-CSP type excavation method.

Such a third configuration is, indeed, different from the typical configuration of a standard CSP type excavating machine for the reasons that will be specifically given hereinafter in the present description.

Figure 2:
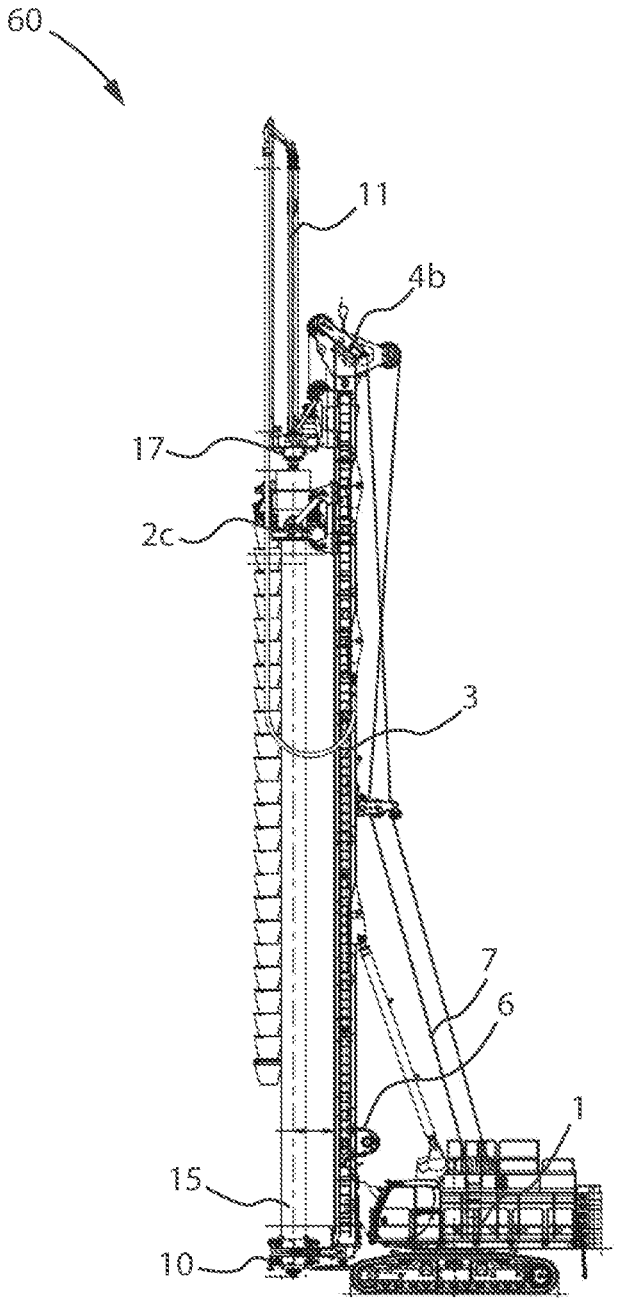
FIG. 2 is a schematic view of an excavating machine in quick-CSP configuration according to the present invention.

FIG. 2 shows an excavating machine 60 of the quick-CSP type. For the sake of simplicity of presentation, details and elements that are similar—or having an analogous function—to those of LDP type, CFA type and CSP type excavating machines described earlier, are associated with the same alphanumeric references.

The excavating machine of the quick-CSP type 60 comprises a supporting machine body or tower 1, a vertical guide tower 3 associated with such a supporting machine body, a head 4*b* fixed to the upper end of the guide tower 3, the modular handling assembly set up for the cased propeller excavation method.

In particular, the quick-CSP excavating machine has the first rotary 2*c* and the second rotary 17 slidably associated with the guide tower 3; preferably, the second rotary 17 is installed in raised position with respect to the first rotary 2*c* i.e. it is installed closer to the head 4*b* than the first rotary 2*c* is. The first rotary 2*c* is in CSP configuration i.e. it is equipped with the wear sleeve for intubator 31 coupled with the dragging sleeve 24. Such a first rotary 2*c* is coupled with a casing and excavating pipe 15, 15*b*, 15*c* while the second rotary 17 is associated directly or indirectly with a continuous excavating propeller 9, 9*b*, 9*c*. In particular, the second rotary 17 can be coupled, like in FIG. 2, with an extension sleeve 11 in turn fixed to an end of the continuous excavating propeller 9, 9*b*, 9*c*.

Preferably, the two rotating tables 2*c*, 17 are associated with a single cable handling system.

Alternatively, the two rotating tables are associated with respective mutually independent cable handling systems.

In an embodiment of the quick-CSP excavating machine, the second rotary 17 is associated with a pulling system arranged to make the rotary translate towards the head of the guide tower 3; such a pulling system comprises a first winch (not illustrated) that can be associated with the machine body or with the guide tower 3 and a relative cable 7.

In an alternative embodiment to the previous one, the quick-CSP excavating machine is provided with a second winch. This additional second pushing winch (not shown) is mounted on one of the two rotaries 17 or 2*c* and the cable of such a winch is connected to the other rotary. In this way, by keeping the first rotary 2*c* stationary, which is always under the second rotary 17, and by actuating the second winch, a downward force is applied to the second rotary 17 that will tend to approach the first rotary 2*c* and therefore will tend to slide downwards. In this version, therefore, it is sufficient to add a "tube sack", to feed the additional second rotary 17. Said tube sack is made up of a bundle of hydraulic tubes that acts as connection between the system part present on the machine body 1 and the second sliding rotary 17, fixed to the guide tower 3 in a suitable manner and of length such as to be able to follow the movement of the rotary.

Figure 1B:
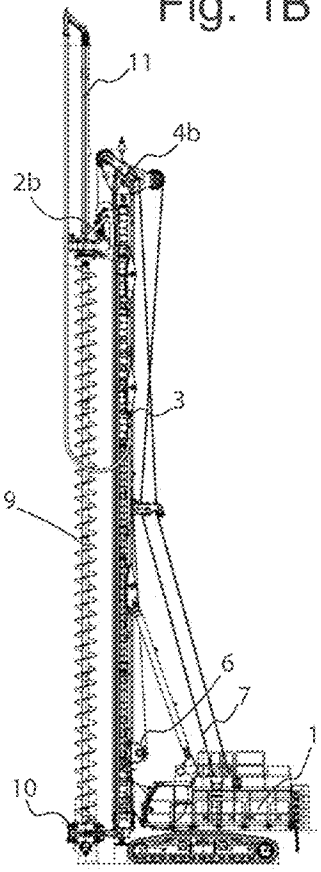
Prior Art Fig. 1B
FIG. 1B is a schematic view of an excavating machine set up for the CFA excavation method according to the prior art.
Figure 1A:
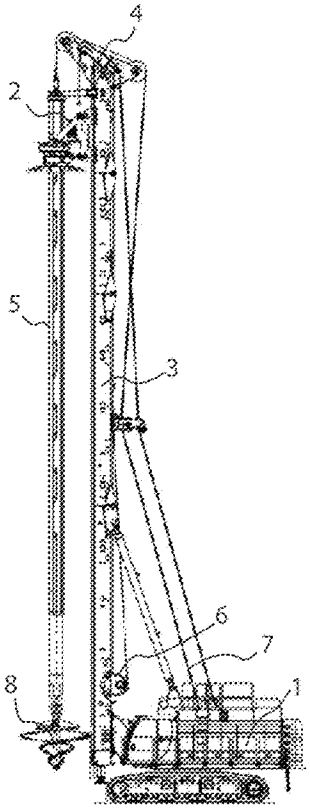
Prior Art Fig. 1A
FIG. 1A is a schematic view of an excavating machine set up for the LDP excavation method according to the prior art.

The quick-CSP head 4*b*, i.e. the head mounted on the quick-CSP machine, can be substantially the same as a CFA head 4*b* like the one illustrated in FIG. 1B or it can be obtained by modifying an LDP head 4 like the one illustrated in FIG. 1A.

It should be specified that in the present description we do not dwell describing the set-up of the pulleys and sheaves present on the excavating machine to transmit the cables for handling the rotaries or the excavating equipment, since these are actuation systems already known in the state of the art.

The difference between the LDP head 4 and the quick-CSP head 4*b* consists of the different centre to centre working distance, i.e. the distance between the guides of the guide tower 3 and the axis of the cable that descends from the front sheave of the head. In order to convert an LDP head into a quick-CSP head it is necessary, therefore, to move the pivot position of the front sheave, for example taking off the relative pin from the seat and slotting it back in a second seat arranged to fix the sheave in a new position.

Alternatively, the LDP head 4 could have a dismountable small front extension on which it is possible to pivot the sheave in a first position, and by dismounting such an extension it is possible to fix the sheave in a second point. These modifications to pass from the LDP head 4 to the quick-CSP head 4*b* can be carried out quickly and particularly they do not require that the head be dismounted or disconnected from the antenna.

The head is fixed to the antenna through numerous screws of large diameter, and therefore disconnecting the head from the antenna would require a lot of time and suitable equipment. The movement of the front sheave or the dismounting of the extension is, on the other hand, a much faster operation since these parts have limited weight and only the insertion or extraction of pins is required without special tools.

Figure 6A:
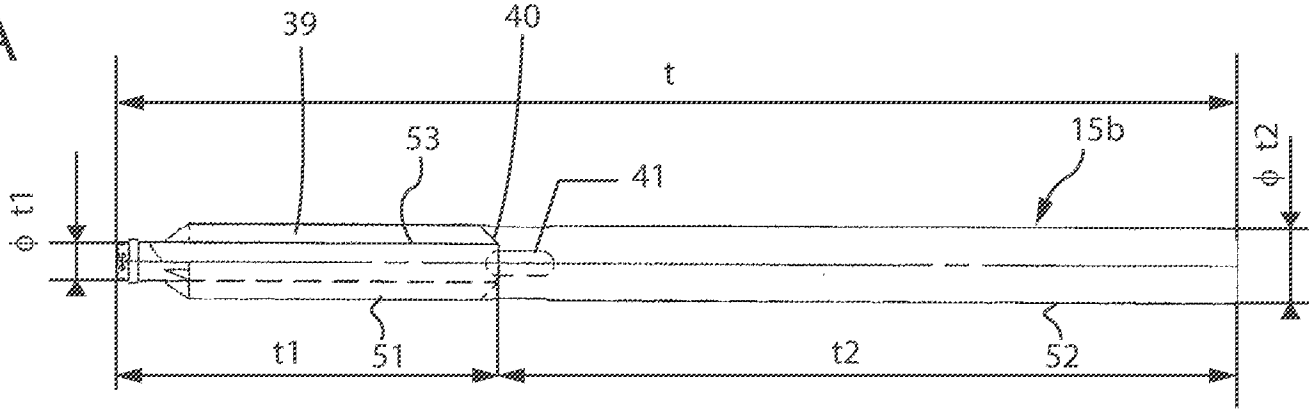
FIG. 6A is a schematic view of a casing and excavating pipe used in a first alternative embodiment of the excavating machine according to the present invention.
Figure 6B:
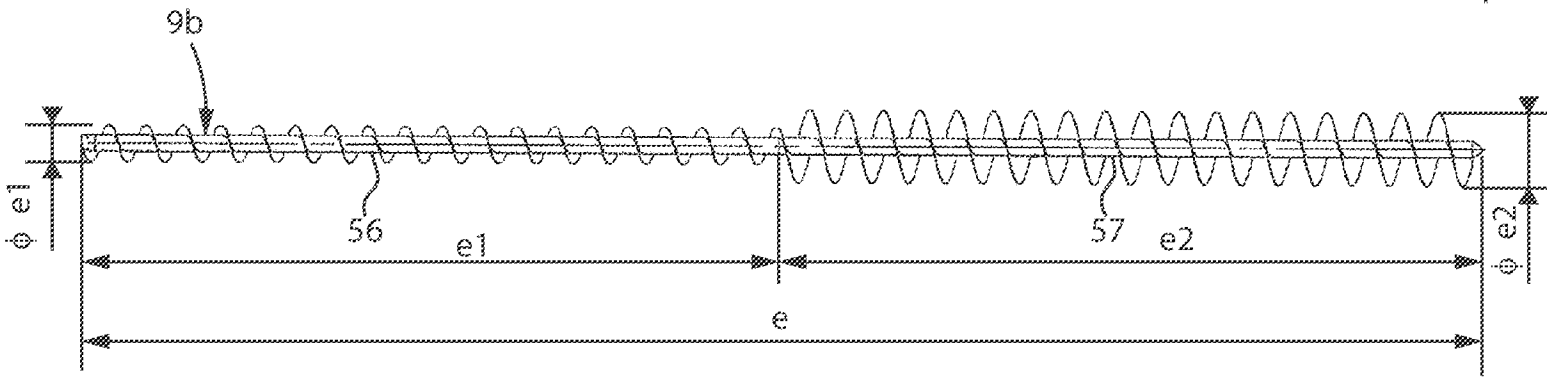
FIG. 6B is a schematic view of a continuous excavating propeller used in a first alternative embodiment of the excavating machine according to the present invention.

In a particular configuration shown in FIG. 6 the quick-CSP excavating machine can allow cased piles of any diameter to be made. In this case, a casing and excavating pipe 15*b* of length t is formed from two distinct longitudinal portions 51, 52 of length t1 and t2, respectively. The first longitudinal portion 51 of length t1 is intended in use to be the closest to the first rotary 2*c*; such a first longitudinal portion 51 encloses a coaxial inner pipe 53 of smaller diameter Øt1 with respect to the casing and excavating pipe 15*b*; such an inner pipe 53 extends substantially for the entire length t1 of the first longitudinal portion 51.

The second longitudinal portion 52 of length t2, with reference to the use configuration, extends from the end of the first longitudinal portion 51 up to the lower edge of the casing and excavating pipe 15*b*. The first longitudinal portion 51 is, therefore, intended in use to be the upper portion of the pipe 15*b*. At the lower end of the first longitudinal portion 51, the inner pipe 53 is connected through a conical ring 40 to the outer pipe. Such a conical ring 40, as well as ensuring the coaxial nature of the inner pipe 53, defines and isolates a gap 39 making it completely fluid-tight. Such a gap 39 therefore has the shape of a hollow cylinder with outer diameter determined by the casing and excavating pipe 15*b*, an inner diameter determined by the inner pipe 53 and a length equal to the segment t1. The first longitudinal portion 51 of the pipe 15*b*, therefore, has a diameter Øt1 smaller than that Øt2 of the second longitudinal portion. On the outer wall of the second longitudinal portion 52 of the casing and excavating pipe 15*b*, under the conical ring 40, a plurality of discharge slots 41, preferably four, are made arranged equally spaced along the circumference of the pipe 15*b*.

Such discharge slots 41, act as openings for unloading debris that rises inside the pipe transported by the continuous propeller 9B.

The continuous excavating propeller 9*b*, visible in FIG. 6, is made up of two distinct longitudinal portions 56, 57 of respective lengths e1, e2: the first longitudinal portion 56 is intended in use to be the closest to the second rotary and has spires of smaller diameter Øe1 with respect to the diameter Øe2 of the second sector e2. The diameter Øe1 of the spires of the first longitudinal portion 56 is suitably sized to be able to pass through the first longitudinal portion 51 of the pipe 15*b* in a flush manner. In particular, the first longitudinal portion 56 of the propeller 9*b* is sized so as to be able to cross the inner passage of the first rotary 2*c*, in particular to cross the diameter of the wear sleeve for intubator 31 with minimum clearance.

The diameter Øe2 of the spires of the second longitudinal portion 57 of the propeller is suitably sized so as to be able to pass through the inner passage of the casing and excavating pipe 15*b* with minimum clearance and therefore the diameter of the spires in this segment is limited by the diameter of the selected pipe.

When the continuous excavating propeller 9*b* is completely contained in the casing and excavating pipe 15*b*, i.e. the second longitudinal portion 57 of the propeller 9*b* is contained in the second longitudinal portion 52 of the casing and excavating pipe 15*b*, the ground that rises along the second longitudinal portion 52 of the pipe 15*b* pushed by the rotation of the continuous excavating propeller 9*b* is in part unloaded outside of the casing and excavating pipe 15*b* through the slots 41. The shape of the conical ring 40, which has a divergent shape towards the upper part of the casing and excavating pipe 15*b*, acts as a guide and helps the ground to come out from the slots 41.

FIGS. 7A-7G show an excavation and subsequent rising sequence through an excavating machine in Quick-CSP set-up that uses the continuous excavating propeller 9*b* and the casing and excavating pipe 15*b* according to the variant embodiment just described. In the figures, for greater clarity neither the machine body 1 nor the guide tower 3 is shown, but it should be understood that the rotaries 2*c*, 17 and all of the excavation battery are connected to the guide tower 3 of the machine.

Figures 7A, 7B, 7C, 7D, 7E, 7F, 7G:
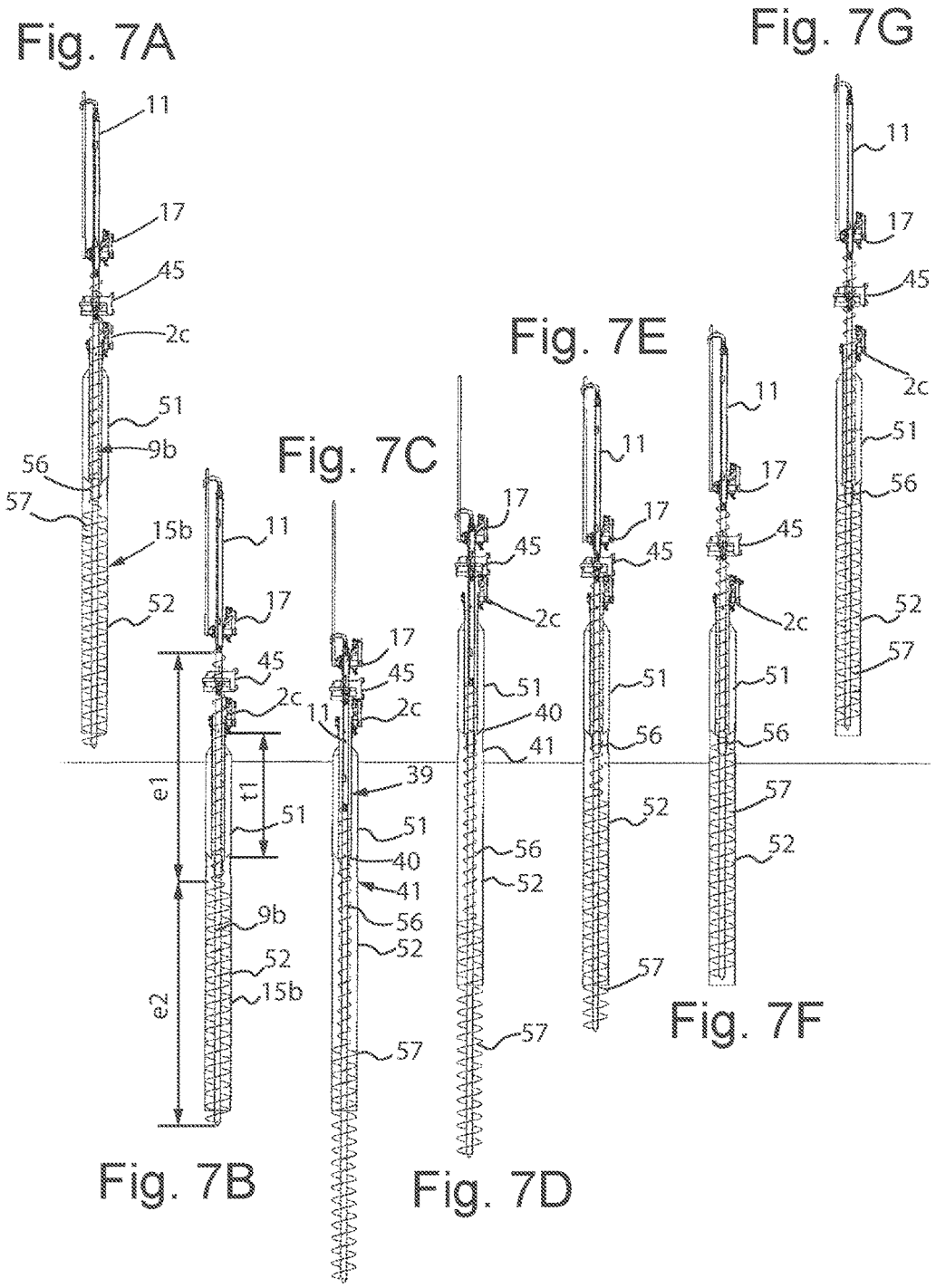
FIGS. 7A to 7G illustrate the excavation steps carried out by the excavating equipment of FIGS. 6A and 6B.

FIG. 7A shows the quick-CSP excavating equipment in position ready to start excavating.

In intermediate position between the two rotaries 2*c*, 17 a per se known roller cleaner 45 is installed to remove the debris from the spires of the continuous excavating propeller 9*b*. The continuous excavating propeller 9*b* can be equipped in the upper part with an extension sleeve 11 as shown in FIG. 7A. The continuous excavating propeller 9*b* thus passes through the entire casing and excavating pipe 15*b*, the first rotary 2*c* and the roller cleaner 45 and through the extension sleeve 11 connects to the wear sleeve (not illustrated) of the second rotary 17. Such an extension sleeve 11 can pass through the second rotary 17, and in this case the wear sleeve of the second rotary 17 will be engaged in the lower attachment of the extension sleeve 11.

In particular, as can be seen in FIG. 7A, the second longitudinal portion 57*e* of the continuous excavating propeller 9*b* that has a greater diameter is contained inside the second longitudinal portion 52 of the casing and excavating pipe 15*b*, while the first longitudinal portion 57 of the continuous excavating propeller 9*b* that has a smaller or decalibrated diameter extends passing through the entire inner pipe 53 present in the first longitudinal portion 51 of the casing and proceeds passing completely through the first rotary 2*c* through the wear sleeve for intubator 31. The first longitudinal portion 56 of the continuous excavating propeller 9*b* extends further passing through the roller cleaner 45 and continues until it connects to the second rotary 17, directly or indirectly through the extension sleeve 11 or directly. Again considering FIG. 7A it can be seen that the continuous excavating propeller 9*b* starting from this position cannot rise further sliding with respect to the pipe since the second longitudinal portion 57 of the propeller cannot pass through the first longitudinal portion 51 of the casing and excavating pipe 15*b* since it has a greater diameter than this last segment.

FIG. 7B shows the first step of making the cased excavation, in which both the continuous excavating propeller 9*b* and the casing and excavating pipe 15*b* are made to advance simultaneously, without mutual sliding keeping the propeller slightly advanced with respect to the lower edge of the pipe or completely withdrawn inside the pipe; this second case is preferable for making secondary piles. During the descent the continuous excavating propeller 9*b* is rotated in the clockwise direction and the casing and excavating pipe 15*b* can be rotated preferably in the anti-clockwise direction. In this case, the ground rises along the spires of the continuous excavating propeller 9*b* passing through the entire casing and excavating pipe 15*b* and the first rotary 2*c* until the roller cleaner 45 is reached that removes the ground from the spires and sends it into a conveyor that unloads the debris on ground level at low height.

Once the entire casing and excavating pipe 15*b* is inserted in the ground, the second rotary 17 is momentarily released from the lower attachment of the extension sleeve 11 and it is translated upwards until it engages in the upper attachment of the extension sleeve 11. During this translation, also called "sleeve recovery", both the continuous excavating propeller 9*b* and the casing and excavating pipe 15*b* remain stationary.

At this point, the second rotary 17 can descend again along the guide tower 3, as shown in FIG. 7C, setting the continuous excavating propeller 9*b* in rotation and making it advance outside of the casing and excavating pipe 15*b* while the pipe stays at constant height. The continuous excavating propeller 9*b* thus reaches the maximum depth, and in the segment outside of the casing and excavating pipe 15*b* carries out an excavation with diameter substantially equal to the inner diameter of the pipe.

Thereafter, in FIG. 7D the simultaneous rising of the continuous excavating propeller 9*b* and of the casing and excavating pipe 15*b* begins, keeping the propeller in clockwise rotation to promote the rising of the debris. During this rising the jet of the cement is carried out on the bottom of the excavation that is made, making the cement pass inside the continuous excavating propeller 9*b* until it comes out from the lower end. As soon as the slots 41 of the casing and excavating pipe 15*b* come out from the ground and are completely above ground level, the rising of the pipe 15*b* is stopped while the second rotary 17 is still made to slide on the guide tower 3 to make the continuous excavating propeller 9*b* rise, generating a relative translation between propeller and pipe. In this step, the ground that rises from the lower part of the casing and excavating pipe 15*b* pushed by the rotation and translation of the continuous excavating propeller 9*b*, is unloaded on ground level through the slots 41. A modest part of the ground remains between the spires of the first longitudinal portion 56 of the propeller and rises inside the first longitudinal portion 51 of the pipe having reduced diameter then passing through the first rotary 2*c* until the roller cleaner 45 is reached.

When the second longitudinal portion e2 of the propeller has almost completely entered in the pipe, the second rotary 17 momentarily disengages from the upper attachment of the extension sleeve 11 and it is made to slide downwards with respect to the extension sleeve itself so as to engage it in the lower attachment of the sleeve as shown in FIG. 7E.

At this point, as can be seen in FIG. 7F, it is possible for the continuous excavating propeller 9*b* to continue to rise with respect to the casing and excavating pipe 15*b*, until the top of the second longitudinal portion 57 of the propeller meets the conical ring 40 that obstructs further rising thereof.

From this moment simultaneous rising of the continuous excavating propeller 9*b* and of the casing and excavating pipe 15*b* is carried out through the movement of the respective rotary 17 and 2*c*. During rising, the rotation of the continuous excavating propeller 9*b* and possibly also of the casing and excavating pipe 15*b* is maintained, while the jet of the cement is carried out.

At the end of the rising, both the continuous excavating propeller 9*b* and the casing and excavating pipe 15*b* are extracted from the ground and the machine is substantially in the same condition of FIG. 7A, ready to carry out a new excavation. The pile made as described up to now has a depth substantially equal to that of the continuous excavating propeller 9*b* or even greater if the extension sleeve 11 is used and has a diameter substantially equal to that of the casing and excavating pipe 15*b*, thus a greater diameter with respect to the inner passage of the first rotary 2*c* and of its wear sleeve for intubator 31. The lengths e1, e2 of the longitudinal portions 56, 57 of the propeller are suitably selected and are proportioned to the lengths of the two longitudinal portions 51 and 52 of the casing and excavating pipe 15*b*; in this way, it is possible to have a substantial freedom of vertical excursion between propeller 9*b* and pipe 15*b*, i.e. they can mutually translate allowing the propeller 9*b* to project with respect to the lower end of the pipe 15*b* by a large height.

Figure 8A:
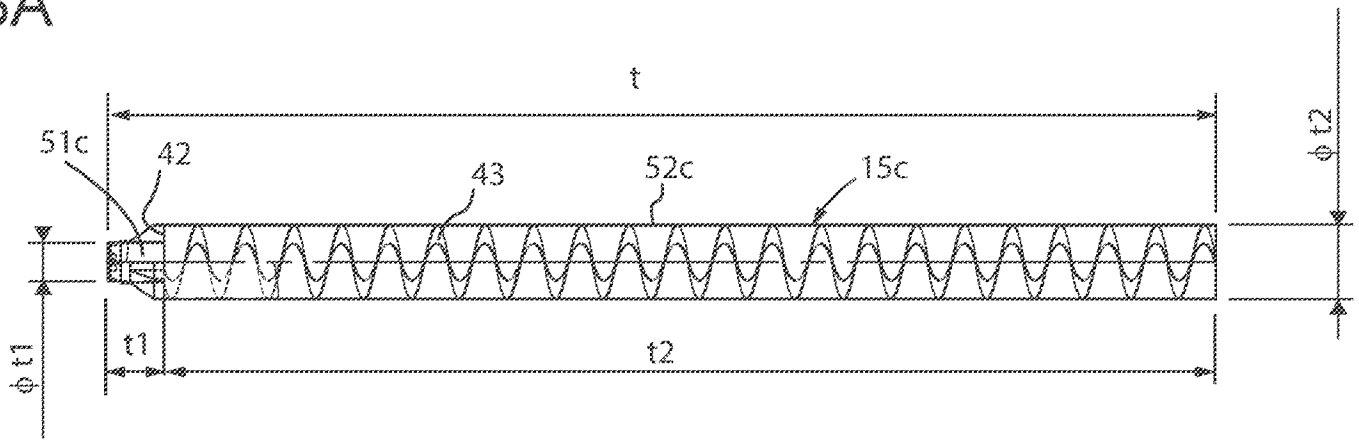
FIG. 8A is a schematic view of a casing and excavating pipe used in a second alternative embodiment of the excavating machine according to the present invention.
Figure 8B:
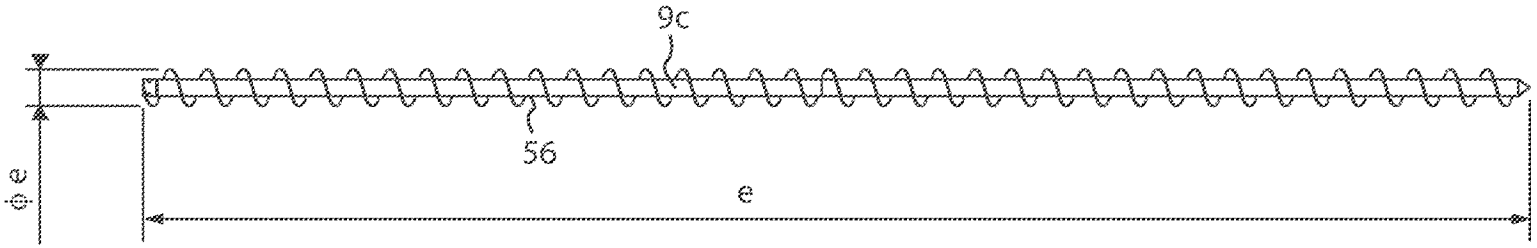
FIG. 8B is a schematic view of a continuous excavating propeller used in a second alternative embodiment of the excavating machine according to the present invention.

In a further variant embodiment of the quick-CSP type excavating machine, the first rotary 2*c* is connected to a second alternative embodiment of a casing and excavating pipe 15*c* visible in FIG. 8A, whereas the second rotary 17 is connected to a second embodiment of a continuous excavating propeller 9*c* visible in FIG. 8B.

The casing and excavating pipe 15*c* has a structure similar to that of the first embodiment 15*b* but the length of the first sector 51*c* has been reduced to the minimum sufficient to allow the connection to the first rotary 2*c*. The upper end of the second sector 52*c*, i.e. the end close to the first sector 51*c*, has discharge openings 42, made in the annular space comprised between the two diameters of the first sector and of the second sector, and such discharge openings 42 allow a part of the ground present inside the casing and excavating pipe to come out during the excavation steps. The casing and excavating pipe 15*c* has the additional characteristic of having an inner helix (or propeller) at the pipe for the entire second sector 52*c*, which is the segment with greater diameter. For the entire extension in length of the second sector 52*c*, the casing and excavating pipe 15*c* has inner annular spires 43, which have the outer edges of the spires welded to the inner wall of the pipe. Said inner annular spires 43 each have a circular central hollow, thus forming a cylindrical passage coaxial to the pipe.

Such an inner cylindrical passage has substantially the same diameter Øt1 as the first sector 51 of the pipe. The annular helix inside the pipe 15*c* has the annular spires 43 that wind in the opposite direction with respect to that of the continuous excavating propeller 9*c*. In this way, if the spires of the continuous excavating propeller 9*c* tend to make the ground rise along the propeller when the propeller is set in clockwise rotation, the inner annular spires of the casing and excavating pipe 15*c* tend to make the ground rise upwards inside the pipe when the pipe is set in anti-clockwise rotation. The continuous excavating propeller 9*c* has the spires that exhibit a single constant diameter for the entire length (e) of the propeller and therefore it can be considered to be formed from a single longitudinal portion (e). It should be understood that only the longitudinal portion (e) can be made up of a plurality of propeller segments, all with spires of equal diameter, assembled to one another. In particular, such spires have a diameter that is decalibrated or reduced to a value suitable for allowing the passage of the continuous excavating propeller itself through the entire casing and excavating pipe 15*c* and therefore through all of the annular spires 43 of the inner helix. Therefore, the diameter (Øe1) of the continuous excavating propeller 9*c* is slightly smaller with respect to the diameter of the first sector 51 of the pipe 15*c*, i.e. less than Øt1 and in the same way it will be slightly less than the inner passage of the annular spires 43.

The spires of the continuous excavating propeller 9*c* and the inner spires of the casing and excavating pipe 15*c* are therefore never parallel, since they wind in opposite directions, but they always cross over, i.e. the inner edges of the spires of the pipe will always have opposite inclination with respect to the outer edges of the spires of the propeller. This ensures that in the interface area between the two propellers they never tend to lock into one another.

The entire length of the continuous excavating propeller 9*c*, being entirely decalibrated, can pass through the first rotary 2*c*. This allows to have the maximum possible excursion between propeller 9*c* and pipe 15*c*, as can be seen in FIGS. 9A and 9B.

Figure 9B:
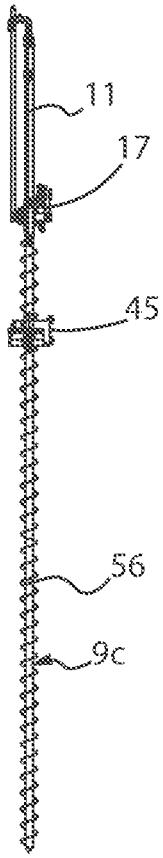
FIGS. 9A and 9B illustrate some excavation steps carried out by the excavating equipment of FIGS. 8A and 8B.
Figure 9A:
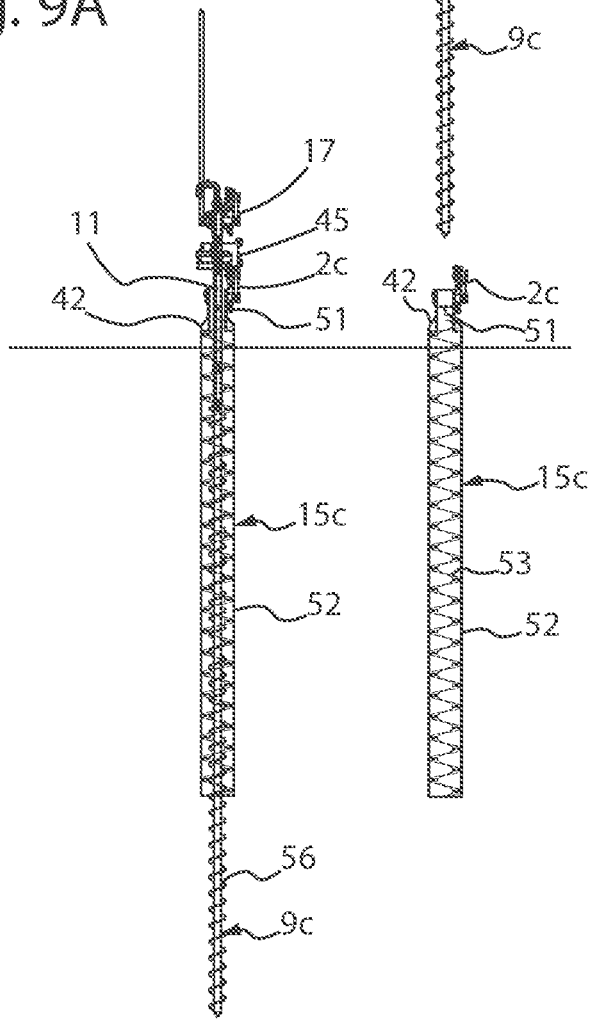

Starting from the excavating configuration shown in FIG. 9A, in which both the propeller 9*c* and the pipe 15*c* are at their maximum reachable depth, it is possible to make only the propeller 9*c* translate without making the pipe 15*c* translate, until the propeller 9*c* has reached the highest possible height, i.e. with propeller and sleeve 11 completely raised, as can be seen in FIG. 9B. In particular, as a function of the lengths selected for the propeller 9*c* and for the pipe 9C, it is possible for the translating propeller 9C to completely pass through the pipe 15 until it comes out from the top of the pipe as shown in FIG. 9B.

During the excavation, the continuous excavating propeller 9*c* and the casing and excavating pipe 15*c* are set in rotation with opposite directions. This ensures that a friction is generated between the ground that is located between the spires of the propeller 9*c* and the material that is located between the inner spires of the pipe 15*c*. Such friction allows the ground to rise along the inner spires of the pipe until the discharge openings 42 are reached, through which a part of the excavated ground can come out from the pipe. Another part of the excavated ground, in particular that which is located between the spires of the propeller 9C, can on the other hand rise passing through the lower rotary 2*c*, to then be removed by the cleaner 45.

The excavation and subsequent rising sequence through an excavating machine in Quick-CSP set-up that uses the second embodiment of a continuous excavating propeller 9*c* and of a casing and excavating pipe 15*c*, is analogous to the sequence already described with reference to FIGS. 7A-7G, having the further advantage of allowing more extensive mutual sliding between the propeller 9*c* and the pipe 15*c*.

The method for converting an excavating machine from an LDP or CFA type excavating configuration to a CSP type excavating configuration, according to the present invention, comprises the steps of:

dismounting the telescopic Kelly rod 5 or the continuous excavating propeller 9 from the first rotary 2*c;* dismounting the accessories 27, 29 of the plurality of accessories coupled with said first rotating table 2*c*; in the case in which the starting excavating configuration is that of the LDP type the wear sleeve 27 is thus dismounted, otherwise if the starting configuration is of the CFA type the wear sleeve 27 and the diameter adapter sleeve 29 are dismounted;

coupling the wear sleeve for intubator 31 with the dragging sleeve 24 of the first rotary 2*c;* associating the second rotary 17 with the guide tower 3 above the first rotary 2*c;* associating hydraulic systems and a cable handling system with the second rotary 17;

associating a continuous excavating propeller 9, 9*b*, 9*c* with the second rotary 17 and a casing and excavating pipe 15, 15*b*, 15*c* with the first rotary 2*c*.

Such a conversion method is very advantageous with respect to that provided in the state of the art.

Indeed, converting the excavating machine into a configuration of the quick-CSP type by suitably setting up the modular handling assembly described above the following advantages are obtained:

it is not necessary to change the head 4, 4*b* nor dismount the rotary that drags the telescopic Kelly rod 5 or the continuous propeller 9; therefore, it is not necessary to dismount or modify the turning of the cables that command the translation of the rotary;

it is not necessary to modify or dismount the hydraulic systems (pipes) that connect the machine body 1 to the rotary 2*c;* it is not necessary to mount an intubator 13 on the guide tower 3 of the machine nor to mount the relative hydraulic feeding systems;

it is not necessary to repeat or add the turning of the cables for the movement of the intubator.

Indeed, the first rotary 2*c* dedicated to the movement of the pipe keeps the same guide trolley and the same pulling members that were connected when the machine is set up in LDP or in CFA. This constitutes a great advantage since it means that to pass from the LDP or CFA set-up to the quick-CSP set-up it is not necessary to modify the paths of the cables that starting from the winch 6 actuate the trolley of the first rotary 2*c* nor for that matter it is necessary to replace the trolley or any parts thereof like the pulleys.

From the economic point of view the following considerations can be made:

to convert, according to the prior art, an excavating machine set up in LDP or in CFA into one set up in standard CSP of FIG. 1C it is necessary to acquire: a rotary 12, an intubator 13 and a head 16;

in order to carry out such conversions, according to the present invention, it is sufficient to acquire the configurable modular handling assembly described above.

The economic saving is obvious, and it is worth also considering all the hours of work saved for the transformation.

From the description that has been made the characteristics of the modular handling assembly, of the conversion method and of the excavating machine object of the present invention are clear, just as the relative advantages are also clear.

The modularity of the modular handling assembly of the present invention, indeed, allows easier transformation of the machine from an LDP set-up to a CSP set-up, reducing the number of mounting/dismounting operations to be carried out, reducing the number of components (rotaries, heads, winches) necessary to be able to have both of the set-ups and reducing the costs of the conversion from one set-up to another.

The proposed solution allows, in the CSP set-up, to reuse the same rotary (2*c*) used in the LDP or CFA set-up. With this solution the aforementioned rotary is configured to have performance compatible with use as intubator but at the same time it keeps compact dimensions with respect to the known intubators because the inner passage of the rotary is increased with respect to the outer diameter of the wider telescopic Kelly rod that can be used with that rotary.

By then using few interfacing adapters for dragging the casing and excavating pipe (casing) and adding a single new rotary for dragging the continuous excavating propeller a quick and efficient combination for the conversion to different excavation technologies is obtained. The investment for the conversion from LDP to quick-CSP is very low with respect to a conversion from LDP to Standard CSP given that it is not necessary to acquire and install a new intubator. The system modifications are also more contained given that the rotary 2*c* that is used as intubator remains connected to the same hydraulic feeds that it already had in normal use as a rotary and in the same way it keeps its handling systems unchanged, i.e. the turning of the cables and the pulleys that connect it in this case to the winch 6.

Finally, it is clear that the device thus conceived can undergo numerous modifications and variants, all of which are covered by the invention; moreover, all of the details can be replaced by technically equivalent elements. In practice, the materials used, as well as the sizes, can be whatever according to the technical requirements.

The invention claimed is:

1. A modular assembly for handling excavating equipment for various excavating configurations of an excavating machine, comprising:

a first rotating table comprising:

a main body;

one or more motors associated with said main body, each of said motors being provided with a pinion;

a bearing having a fixed ring constrained to said main body and a movable ring which is coaxial to and rotatable with respect to said fixed ring;

a dragging sleeve integrally coupled to said movable ring coaxially to said bearing;

a ring gear integrally and coaxially coupled with said dragging sleeve and provided to engage with said pinion so as to be moved in rotation by said motors by rotating integrally to said dragging sleeve and integrally to said movable ring;

a second rotating table adapted to be coupled to a continuous excavating auger; and a plurality of accessories which can be associated with said first rotating table so that said first rotating table can be selectively coupled to a telescopic Kelly rod in a first of said excavating configurations, or with a continuous excavating auger in a second of said excavating configurations or with a casing and excavating pipe in a third of said excavating configurations, wherein said plurality of accessories comprises:

a wear sleeve for Kelly rods arranged to be coupled integrally and coaxially to said dragging sleeve and to transmit the rotary motion to a Kelly rod;

a diameter adapter sleeve for augers arranged to be coupled integrally and coaxially to said wear sleeve for Kelly rods and to transmit the rotary motion to a continuous excavating auger;

a wear sleeve for intubator arranged to be coupled integrally and coaxially to said dragging sleeve and to transmit the rotary motion to a casing and excavating pipe;

said first rotating table being equipped with said wear sleeve for Kelly rods in said first excavating configuration, with said wear sleeve for Kelly rods and said diameter adapter sleeve in said second excavating configuration, with said wear sleeve for intubator in said third excavating configuration.

2. A modular assembly for handling excavating equipment for excavating machines according to claim 1, wherein said second rotating table is substantially equal to said first rotating table equipped with said wear sleeve for Kelly rods and said diameter adapter sleeve.

3. A modular assembly for handling excavating equipment for excavating machines according to claim 1, wherein a ratio between an inner diameter of said dragging sleeve and an outer diameter of the telescopic Kelly rod intended to be coupled to said first rotating table is between 1.25 and 1.5.

4. A modular assembly for handling excavating equipment for excavating machines according to claim 1, wherein a ratio between an inner diameter of said wear sleeve for intubator and an outer diameter of the telescopic Kelly rod intended to be coupled to said first rotating table is between 1.25 and 1.35.

5. A modular assembly for handling excavating equipment for excavating machines according to claim 1, wherein said motors of said first rotating table comprise a spin-off motor.

6. An excavating machine comprising:

a supporting machine body a guide tower associated with said machine body;

a modular assembly for handling excavating equipment according to claim 1, wherein said first rotating table is equipped with said wear sleeve for intubator, said first rotating table and said second rotating table being slidably associated with said guide tower, said second rotating table being installed in raised position with respect to said first rotating table;

a casing and excavating pipe associated with said first rotating table;

a continuous excavating auger adapted to slide in said casing and excavating pipe and associated with said second rotating table.

7. An excavating machine according to claim 6, wherein said first rotating table and said second rotating table are associated with a single cable handling system.

8. An excavating machine according to claim 6, wherein said first rotating table and said second rotating table are associated with respective cable handling systems independent with respect to one another.

9. An excavating machine according to claim 6, wherein said casing and excavating pipe is formed by two separate longitudinal portions, a first longitudinal portion of a first length (t1) and a second longitudinal portion of a second length (t2), respectively, said first longitudinal portion having a smaller inner diameter with respect to the one of said second longitudinal portion, said first longitudinal portion intended in use to be an upper portion of said casing and excavating pipe, a plurality of discharge slots being made on an outer wall of said second longitudinal portion of said casing and excavating pipe at an interface with said first longitudinal portion of said pipe, said continuous excavating auger being formed by two separate longitudinal portions, a first longitudinal portion of a first length (e1) and a second longitudinal portion of a second length (e2), respectively, said first longitudinal portion of said continuous excavating auger being sized so as to pass through said first longitudinal portion of said casing and excavating pipe in a flush manner, said second longitudinal portion of said continuous excavating auger being sized so as to pass through said second longitudinal portion of said casing and excavating pipe in a flush manner.

10. An excavating machine according to claim 6, wherein said casing and excavating pipe is formed by two separate longitudinal portions, a first longitudinal portion of a first length (t1) and a second longitudinal portion of a second length (t2), respectively, said first longitudinal portion having a smaller inner diameter with respect to the one of said second longitudinal portion, said first longitudinal portion intended in use to be an upper portion of said casing and excavating pipe, a plurality of discharge openings being made in an upper end at an interface with said first longitudinal portion of said pipe, said second longitudinal portion having an inner helix formed by inner annular spires each having a circular central hollow, said inner spires thus forming a cylindrical passage substantially having the same diameter as said first longitudinal portion of the pipe, said continuous excavating auger being formed by a single longitudinal portion of length (e), sized so as to pass through said first longitudinal portion of said casing and excavating pipe in a flush manner and so as to pass through said inner spires of said casing and excavating pipe in a flush manner.

11. A method for converting an excavating machine from a first excavating configuration with a Kelly rod or from a second excavating configuration with a continuous excavating auger to a third excavating configuration with a continuous cased excavating auger, where said excavating machine comprises:

a supporting machine body;

a guide tower associated with said machine body;

a modular handling assembly according to claim 1, wherein in said first excavating configuration said first rotating table is equipped with said wear sleeve for Kelly rods and in said second excavating configuration said first rotating table is equipped with said wear sleeve for Kelly rods and with said diameter adapter sleeve, said method comprising the steps of:

disassembling said telescopic Kelly rod or said continuous excavating auger from said first rotating table;

disassembling the accessories of said plurality of accessories coupled to said first rotating table;

coupling said wear sleeve for intubator to said dragging sleeve of said first rotating table;

associating said second rotating table with said guide tower at the top of said first rotating table;

associating hydraulic systems and a cable handling system with said second rotating table;

associating said continuous excavating auger with said second rotating table and a casing and excavating pipe with said first rotating table.

* * * * *